United States Patent [19]

Noguchi et al.

[11] 4,176,650

[45] Dec. 4, 1979

[54] METHOD FOR OPERATING A MULTI-CYLINDER JUMP-SPARK IGNITION ENGINE AND OPERATION CONTROL SYSTEM THEREOF

[75] Inventors: Masaaki Noguchi, Nagoya; Yukiyasu Tanaka, Okazaki; Taro Tanaka, Chiryu, all of Japan

[73] Assignee: Nippon Soken, Inc., Nishio, Japan

[21] Appl. No.: 874,931

[22] Filed: Feb. 3, 1978

[30] Foreign Application Priority Data

| | | | |
|---|---|---|---|
| Feb. 10, 1977 | [JP] | Japan | 52/13591 |
| Feb. 15, 1977 | [JP] | Japan | 52/15263 |
| Feb. 18, 1977 | [JP] | Japan | 52/17479 |
| Mar. 4, 1977 | [JP] | Japan | 52/24273 |

[51] Int. Cl.[2] ..... F02D 13/06

[52] U.S. Cl. ..... 123/198 F; 123/DIG. 7; 123/65 R

[58] Field of Search ..... 123/198 F, DIG. 1, DIG. 7, 123/65 R, 76, 65 E, 65 VB, 65 VC, 65 WA

[56] References Cited

U.S. PATENT DOCUMENTS

| | | | |
|---|---|---|---|
| 3,941,113 | 3/1976 | Baguelin | 123/198 F |
| 3,963,379 | 6/1976 | Veno | 123/198 F |
| 4,061,055 | 12/1977 | Lizuka et al. | 123/198 F |
| 4,064,861 | 12/1977 | Schulz | 123/198 F |
| 4,075,837 | 2/1978 | Hanaoka | 123/198 F |
| 4,106,471 | 8/1978 | Nakajima et al. | 123/198 F |
| 4,107,921 | 8/1978 | Lizuka | 123/198 F |

*Primary Examiner*—Ira S. Lazarus

*Attorney, Agent, or Firm*—Cushman, Darby & Cushman

[57] ABSTRACT

In a non-load operation of a multi-cylinder internal combustion engine, both suction flow of newly supplied air-fuel mixture to be introduced in a first combustion chamber and exhaust flow of combustion gas to be exhausted from the first combustion chamber or only the exhaust flow is throttled to carry out compression ignition combustion in the first combustion chamber, while suction flow of newly supplied air-fuel mixture to be introduced into a second combustion chamber is blocked to stop combustion in the second combustion chamber to increase a gas feed rate in the first chamber, to thereby cause a kind of run-on phenomenon in the engine in non-load condition.

33 Claims, 27 Drawing Figures

FIG. 4

| THROTTLE VALVE APER-TURE / R. P. M | SWITCH 701 ON | SWITCH 702 ON | SWITCH 703 ON | SWITCH 701 ~709 OFF |
|---|---|---|---|---|
| $N < n_1 < n_2$ | II | III | IV | VIII (V) |
| $n_1 < N < n_2$ | VII | X (III) | XI (IV) | IX (V) |
| $n_1 < n_2 < N$ | VI | XII (V) | XIII (IV) | V |

FIG. 5

| OPERATION MODE | ACTUATED CONDITIONS OF VALVES | | | | | COMBUSTION MODE | | IGNITION TIMING |
|---|---|---|---|---|---|---|---|---|
| | VALVE 20a | VALVE 20b | VALVE 30 | VALVE 41 | DEVICE 52 | CHAMBER Ca | CHAMBER Cb | |
| I (WARM-UP) | FULL-OPENED | FULL-OPENED | FULL-OPENED | CLOSED | ATMOSPHERE | JUMP-SPARK IGNITION COMBUSTION | JUMP-SPARK IGNITION COMBUSTION | NORMAL |
| II (NO-LOAD) | HALF-OPENED | CLOSED | HALF OPENED | OPENED | ATMOSPHERE | COMPRESSION IGNITION COMBUSTION | COMBUSTION OPERATION STOPPED | NORMAL |
| III | HALF-OPENED | FULL-OPENED | HALF-OPENED | CLOSED | SUCTION VACUUM | COMPRESSION IGNITION COMBUSTION | JUMP-SPARK IGNITION COMBUSTION | ADVANCED |
| IV (LOW-LOAD) | HALF-OPENED | HALF-OPENED | HALF-OPENED | CLOSED | ATMOSPHERE | COMPRESSION IGNITION COMBUSTION | COMPRESSION IGNITION COMBUSTION | NORMAL |
| V (NORMAL-RUNNING) | FULL-OPENED | FULL-OPENED | FULL-OPENED | CLOSED | ATMOSPHERE | JUMP-SPARK IGNITION COMBUSTION | JUMP-SPARK IGNITION COMBUSTION | NORMAL |
| VI (DECELERATION) | CLOSED | CLOSED | FULL-OPENED | CLOSED | ATMOSPHERE | COMBUSTION OPERATION STOPPED | COMBUSTION OPERATION STOPPED | NORMAL |
| VII (DECELERATION) | FULL-OPENED | CLOSED | FULL-OPENED | OPENED | SUCTION VACUUM | JUMP-SPARK IGNITION COMBUSTION | COMBUSTION OPERATION STOPPED | ADVANCED |
| VIII | FULL-OPENED | FULL-OPENED | FULL-OPENED | CLOSED | ATMOSPHERE | JUMP-SPARK IGNITION COMBUSTION | JUMP-SPARK IGNITION COMBUSTION | NORMAL |
| IX | FULL-OPENED | FULL-OPENED | FULL-OPENED | CLOSED | ATMOSPHERE | JUMP-SPARK IGNITION COMBUSTION | JUMP-SPARK IGNITION COMBUSTION | NORMAL |
| X | HALF-OPENED | FULL-OPENED | HALF-OPENED | CLOSED | SUCTION VACUUM | COMPRESSION IGNITION COMBUSTION | JUMP-SPARK IGNITION COMBUSTION | ADVANCED |
| XI | HALF-OPENED | HALF-OPENED | HALF-OPENED | CLOSED | ATMOSPHERE | COMPRESSION IGNITION COMBUSTION | COMPRESSION IGNITION COMBUSTION | NORMAL |
| XII | FULL-OPENED | FULL-OPENED | FULL-OPENED | CLOSED | ATMOSPHERE | JUMP-SPARK IGNITION COMBUSTION | JUMP-SPARK IGNITION COMBUSTION | NORMAL |
| XIII | HALF-OPENED | HALF-OPENED | HALF-OPENED | CLOSED | ATMOSPHERE | COMPRESSION IGNITION COMBUSTION | COMPRESSION IGNITION COMBUSTION | NORMAL |

FIG. 8

| THROTTLE VALVE APERTURE / R. P. M | SWITCH 70A ON | SWITCH 70A OFF |
|---|---|---|
| $N < n_1 < n_2$ | II | VI (II) |
| $n_1 < N < n_2$ | V | VII (III) |
| $n_1 < n_2 < N$ | IV | III |

FIG. 9

| OPERATION MODE | ACTUATED CONDITIONS OF VALVES | | | | COMBUSTION MODES | |
|---|---|---|---|---|---|---|
| | VALVE 20 | VALVE 20B | VALVE 30 | VALVE 41 | CHAMBER Ca | CHAMBER Cb |
| I (WARM-UP) | FULL-OPENED | FULL-OPENED | FULL-OPENED | CLOSED | JUMP-SPARK IGNITION COMBUSTION | JUMP-SPARK IGNITION COMBUSTION |
| II (NO-LOAD) | HALF-OPENED | CLOSED | HALF-OPENED | OPENED | COMPRESSION IGNITION COMBUSTION | COMBUSTION OPERATION STOPPED |
| III (NORMAL-RUN) | FULL-OPENED | FULL-OPENED | FULL-OPENED | CLOSED | JUMP-SPARK IGNITION COMBUSTION | JUMP-SPARK IGNITION COMBUSTION |
| IV (DECELERATION) | CLOSED | CLOSED | FULL-OPENED | CLOSED | COMBUSTION OPERATION STOPPED | COMBUSTION OPERATION STOPPED |
| V (DECELERATION) | FULL-OPENED | CLOSED | FULL-OPENED | OPENED | JUMP-SPARK IGNITION COMBUSTION | COMBUSTION OPERATION STOPPED |
| VI (ACCELERATION) | FULL-OPENED | FULL-OPENED | FULL-OPENED | CLOSED | JUMP-SPARK IGNITION COMBUSTION | JUMP-SPARK IGNITION COMBUSTION |
| VII (ACCELERATION) | FULL-OPENED | FULL-OPENED | FULL-OPENED | CLOSED | JUMP-SPARK IGNITION COMBUSTION | JUMP-SPARK IGNITION COMBUSTION |

FIG. 12

| OPERATION MODE | ACTUATED CONDITIONS OF VALVES | | | | | COMBUSTION MODES | |
|---|---|---|---|---|---|---|---|
| | VALVE 20-1, 2 | VALVE 20-3 | VALVE 20B | VALVE 30 | VALVE 41 | CHAMBER Ca | CHAMBER Cb |
| I (WARM-UP) | FULL-OPENED | FULL-OPENED | FULL-OPENED | FULL-OPENED | CLOSED | JUMP-SPARK IGNITION COMBUSTION | JUMP-SPARK IGNITION COMBUSTION |
| II (NO-LOAD) | HALF-OPENED | CLOSED OR HALF-OPENED | CLOSED | HALF-OPENED | OPENED | COMPRESSION IGNITION COMBUSTION | COMBUSTION OPERATION STOPPED |
| III (NORMAL RUN) | FULL-OPENED | FULL-OPENED | FULL-OPENED | FULL-OPENED | CLOSED | JUMP-SPARK IGNITION COMBUSTION | JUMP-SPARK IGNITION COMBUSTION |
| IV (DECELERATION) | FULL-OPENED | FULL-OPENED | FULL-OPENED | FULL-OPENED | CLOSED | JUMP-SPARK IGNITION COMBUSTION | JUMP-SPARK IGNITION COMBUSTION |
| V (DECELERATION) | FULL-OPENED | FULL-OPENED | CLOSED | FULL-OPENED | OPENED | JUMP-SPARK IGNITION COMBUSTION | COMBUSTION OPERATION STOPPED |
| VI (ACCELERATION) | FULL-OPENED | FULL-OPENED | FULL-OPENED | FULL-OPENED | CLOSED | JUMP-SPARK IGNITION COMBUSTION | JUMP-SPARK IGNITION COMBUSTION |
| VII (ACCELERATION) | FULL-OPENED | FULL-OPENED | FULL-OPENED | FULL-OPENED | CLOSED | JUMP-SPARK IGNITION COMBUSTION | JUMP-SPARK IGNITION COMBUSTION |

METHOD FOR OPERATING A MULTI-CYLINDER JUMP-SPARK IGNITION ENGINE AND OPERATION CONTROL SYSTEM THEREOF

BACKGROUND AND SUMMARY OF THE INVENTION

The present invention relates to a multicylinder jump-spark ignition engine, and more particularly to a novel operating method therefor and a control system therefor.

In general, in a jump-spark ignition engine, ignitability and stability of combustion are deteriorated in a low speed and low load condition since a proportion of remaining gas to newly supplied suction (fresh) air-fuel mixture increases. Accordingly, the amount of exhaust of unburnt hydrocarbon (HC) increases and combustion efficiency is deteriorated. The above trend is remarkably observed particularly in a 2-cycle jump-spark ignition engine because of disordered combustion and blow-out of newly supplied gas which are inherent to the 2-cycle spark-ignition engine.

Many approaches to resolve the above problem have been heretofore proposed, but known approaches are not sufficient in their effects, to reduce the amount of HC exhaust and cannot materially improve the combustion efficiency.

For example, in a known approach to the 2-cycle jump-spark engine, a laminar flow is fed to prevent the disordered combustion to improve the ignitability and the stability of combustion, or combustion is carried out in only selected ones of multiple cylinders in the non-load (low load) condition or an ignition timing is retarded to control shaft output to thereby increase a proportion of feed gas to reduce mis-ignition rate. Further, in order to prevent the blow-out of new gas, a timed fuel jet system has been known in which fuel is directly jetted into a scavenging port or a cylinder at an appropriate timing. Although those approaches have been effective in preventing either one of the disordered combustion and the blow-out of newly supplied gas, none of them could prevent both. Accordingly, they have been insufficient in the effects of reducing HC and improving the combustion efficiency. Although it is possible to prevent both the disordered combustion and the blow-out of the newly supplied gas by combining the timed fuel jet system with other approach, such a combined system has a practical problem because of its high cost.

It is therefore an object of the present invention to provide inexpensive and practical method and system which attain sufficient purification of exhaust gas of the multi-cylinder jump-spark ignition engine and improve the combustion efficiency thereof. To this end, in accordance with the present invention, based on the fact that the combustion in a so-called run-on phenomenon is the one which includes very small fluctuation and has a very small mis-ignition rate, the combustion in the non-load condition, which usually includes most serious problems in improving the purification of the exhaust gas and the combustion efficiency, is improved by the run-on phenomenon.

The run-on phenomenon per se has been known and it has also been known that the run-on phenomenon is apt to occur in the 2-cycle jump-spark ignition engine. However, the run-on phenomenon is normally apt to occur in a limited operation condition, that is, in a high speed, low load condition, and it has been said that the probability of the occurrence of the run-on phenomenon depends on an air-fuel ratio and a feed gas rate, and the run-on phenomenon usually does not occur in a low speed condition or when the feed gas rate is too low. This is associated with the fact that the run-on phenomenon can be considered as a kind of compression ignition combustion which occurs by natural ignition of newly supplied gas by the newly supplied gas being heated by heat of remaining gas and the temperature rise of the newly supplied gas during the compression thereof. Accordingly, in actual, it is not possible in a normal operation method to improve the combustion by causing the run-on phenomenon to occur in the non-load condition.

In the present invention, taking the causes of the occurrence of the run-on phenomenon into condition, a condition under which the run-on phenomenon can occur in the non-load condition is created to thereby cause the compression ignition combustion to occur in the non-load condition. More particularly, in the present invention, both suction flow and exhaust flow are throttled in the non-load condition to prevent the blow-out of the newly supplied gas, while gas flow in the cylinder is suppressed to enhance the mixing of the newly supplied gas and the remaining gas, and combustion is carried out in only selected ones of the multiple cylinders to increase the feed gas rate in the selected cylinders to thereby cause a kind of run-on phenomenon to occur in the non-load condition.

In implementing the above operation method, it is necessary, in practice, to smoothly shift the operation mode from the normal jump-spark ignition operation to the compression ignition operation, and an effective approach therefor is needed. It is also effective to develop the above operation method such that the combustion occurs in only selected ones of the multiple cylinders in the non-load condition to cause the compression ignition operation to occur in the selected cylinders, while the compression ignition operation is carried out in all of the cylinders in the low load condition. In this case, it is necessary to smoothly shift the operation mode in the other cylinders from the non-load condition to the low load condition. Similar measures are required when the supply of air-fuel mixture to all of the cylinders is blocked in deceleration operation and the operation mode is shifted to the compression ignition operation.

Accordingly, it is another object of the present invention to provide an effective operation method for a jump-spark ignition engine which assures smooth shift of operation mode. This is attained, based on the finding of the inventors that ignition time in the compression ignition operation is much earlier than that in the jump-spark ignition operation, by forcibly advancing the ignition time when the operation mode is shifted from the jump-spark ignition operation to the compression ignition operation to thereby smoothly carry out the shift of operation mode. Furthermore, when the operation mode is shifted from the air-fuel mixture feed blocking operation to the compression ignition operation, the jump-spark operation is temporarily carried out with the forcibly advanced ignition timing to assure smooth shift of the operation mode.

In the present specification, the term "suction flow" is intended to include scavenging gas flow in the 2-cycle engine and normal suction flow in other jump-spark ignition 4-cycle engines. The term "compression ignition operation" herein used means an operation in which air-fuel mixture is substantially spontaneously ignited in the course of compression and it includes an operation in which the jump-spark ignition is used.

BRIEF DESCRIPTION OF THE DRAWINGS

FIG. 4 is a chart which classifies operation modes of the first embodiment by an aperture of a throttle valve and a rotation speed of the engine;

FIG. 5 is a chart showing actuated conditions of valves or the like in respective operation modes;

FIG. 8 shows a chart which classifies operation modes of the second embodiment by the aperture of the throttle valve and the rotation speed of the engine;

FIG. 9 shows a chart illustrating actuated conditions of valves or the like in respective operation modes of the second embodiment;

FIG. 12 shows a chart illustrating actuated conditions of valves or the like in respective operation modes of the third embodiment;

DETAILED DESCRIPTION OF THE PREFERRED EMBODIMENTS

Figure 1:
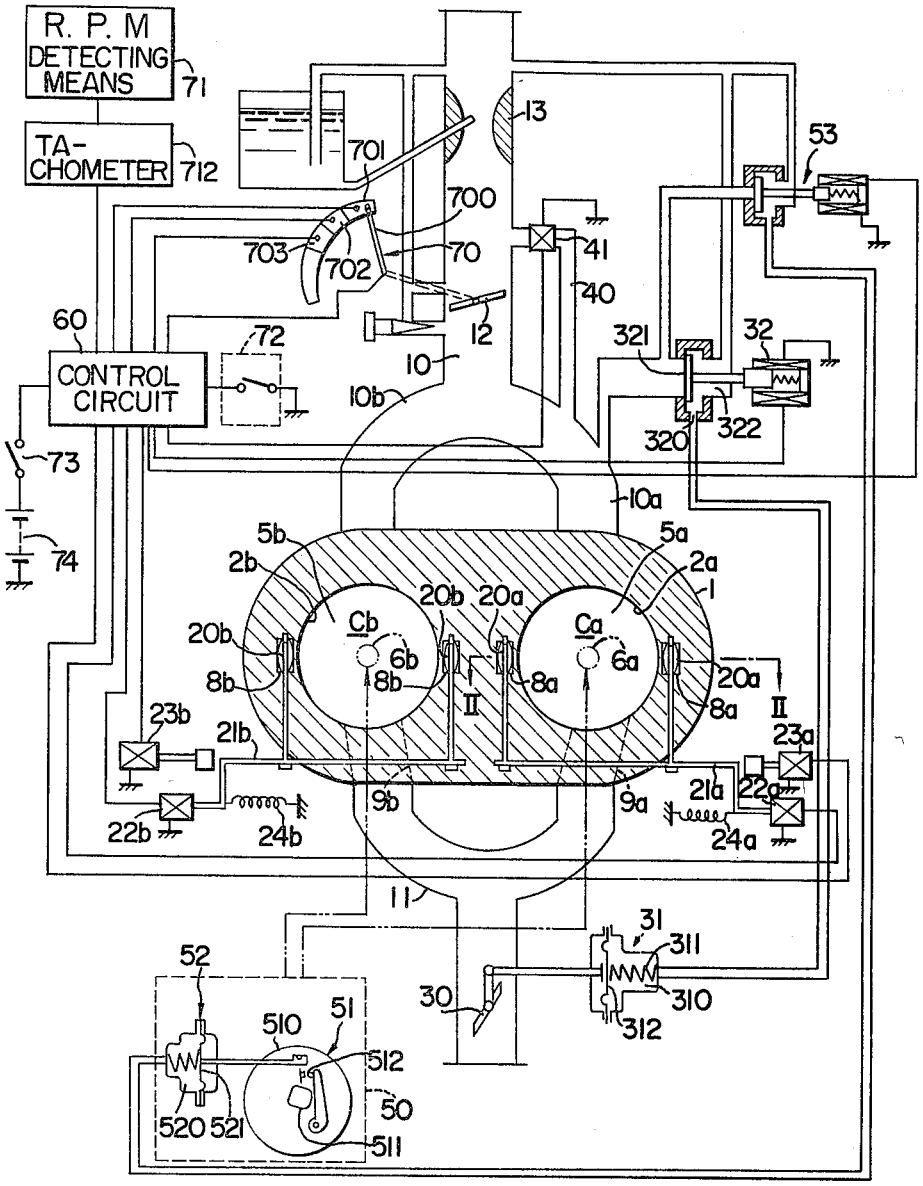
FIG. 1 shows a configuration of an internal combustion engine and associated control system illustrating a first embodiment of the present invention, in which an engine body is shown by a sectional view taken along a line I—I of FIG. 2.
Figure 2:
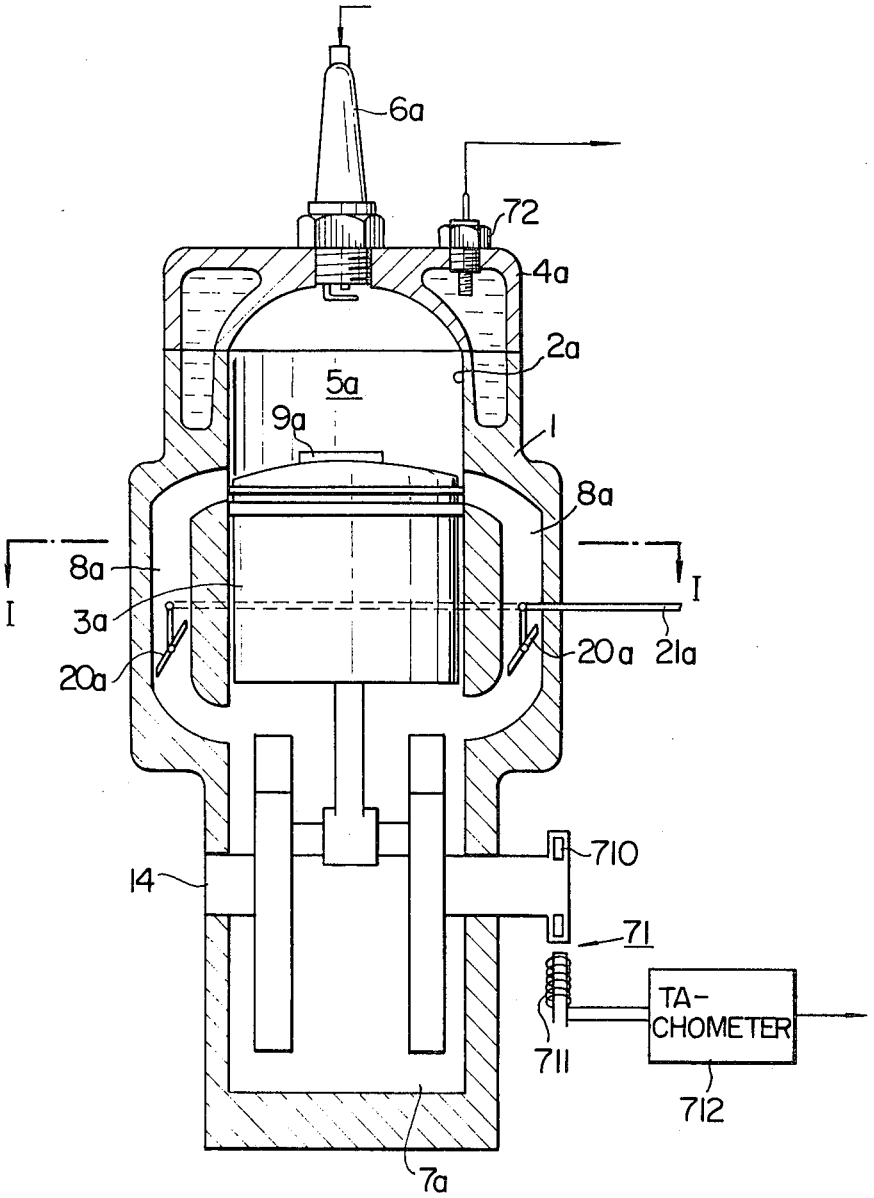
FIG. 2 shows an enlarged sectional view taken along a line II—II of FIG. 1.
Figure 3:
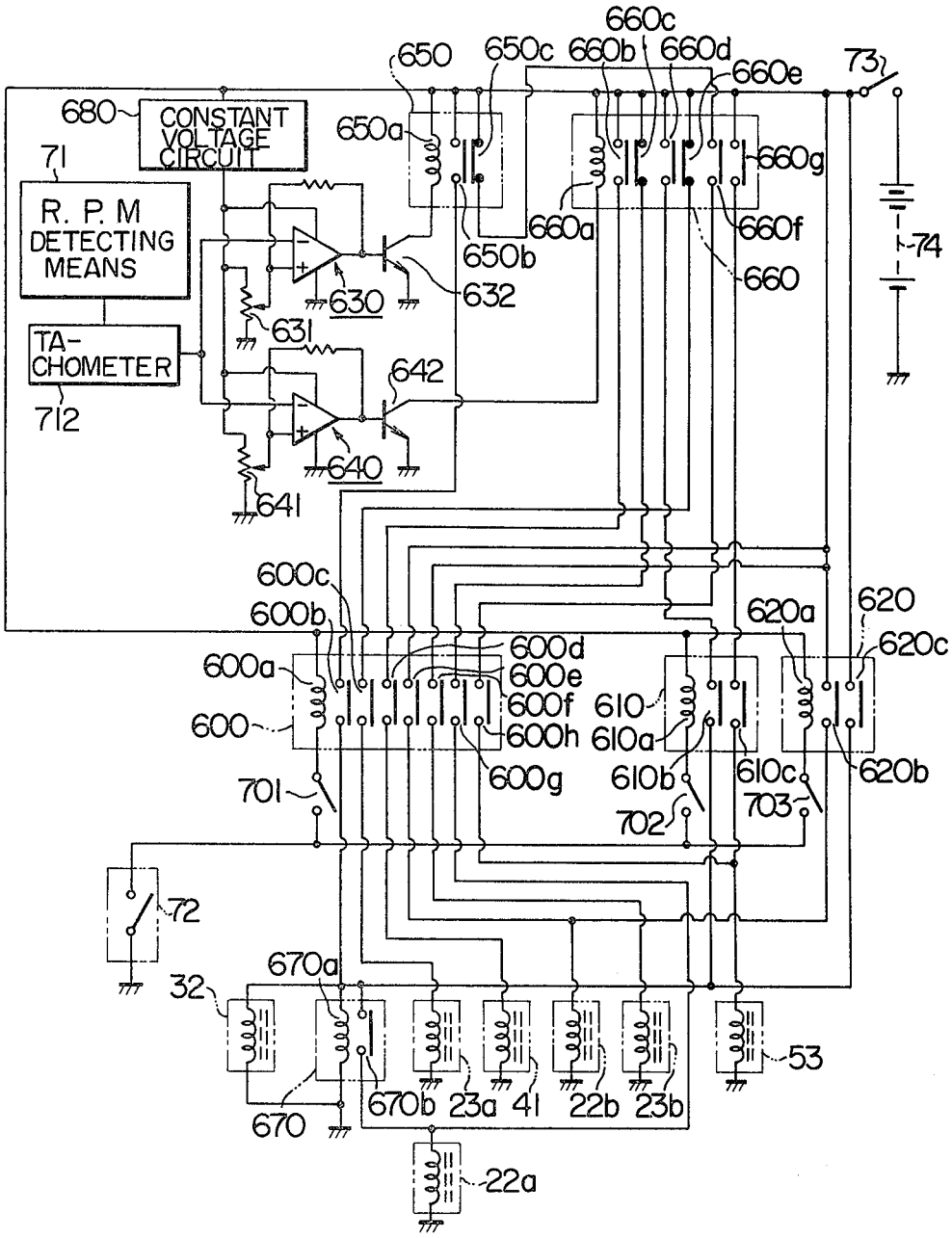
FIG. 3 shows a circuit diagram illustrating detail of a control circuit in FIG. 1.

FIGS. 1, 2 and 3 show a jump-spark ignition engine and a control system therefor for implementing the operation method of the present invention. The engine illustrated herein is a 2-cylinder 2-cycle engine with one (first) of the cylinders being designated as Ca while the other (second) being designated as Cb. The cylinders Ca and Cb are of well-known construction and identical to each other. Pistons 3*a* and 3*b* (the latter being not shown are fitted to cylinder bores 2*a* and 2*b*, respectively, of a cylinder block 1 to form combustion chambers 5*a* and 5*b*, respectively, together with cylinder heads 4*a* and 4*b* (the latter being being not shown). Spark plugs 6*a* and 6*b* are disposed in the combustion chambers 5*a* and 5*b*, respectively. Crank chambers 7*a* and 7*b* are provided below the pistons 3*a* and 3*b*, respectively. The piston 3*b* and the crank chamber 7*b* for the second cylinder Cb are not shown in the drawings. Each of the cylinders Ca and Cb is provided with two scavenging passages 8*a* and 8*b* and an exhaust passage 9*a* or 9*b*. The scavenging passages 8*a* and 8*b* of each cylinder are oppositely arranged to the cylinder bore 2*a* or 2*b* while the exhaust passages 9*a* and 9*b* are arranged to the cylinder bores 2*a* and 2*b*, respectively, at positions not facing the scavenging passages 8*a* and 8*b*. The scavenging passages 8*a* and 8*b* and the exhaust passages 9*a* and 9*b* are opened and closed by reciprocal movement of the corresponding piston 3*a* or 3*b*.

A suction manifold 10 is connected to the crank chambers 7*a* and 7*b* of the cylinders Ca and Cb through suction manifold branches 10*a* and 10*b* having reed valves, not shown, and an exhaust manifold 11 is connected to the exhaust passages 9*a* and 9*b*. A carburettor 13 having a throttle valve 12 is coupled to the suction manifold 10.

According to the present invention, scavenging throttle valve pairs 20*a* and 20*b* are provided in the scavenging passages 8*a* and 8*b* of the cylinders Ca and Cb of the 2-cycle, 2-cylinder jump-stack ignition engine. The pair of scavenging throttle valves 20*a* of the first cylinder Ca are linked to each other by a link 21*a* to which solenoids 22*a* and 23*a* are coupled and a return spring 24*a* is coupled. During deenergized condition (non-actuated condition) of the solenoids 22*a* and 23*a*, the scavenging throttle valves 20*a* are kept in fully open position, and when only the first solenoid 22*a* is energized, the link 21*a* is moved until it abuts against the second solenoid 23*a* which now acts as a stopper so that the scavenging throttle valves 20*a* are partially opened to throttle the scavenging passages 8*a*. When both solenoids 22*a* and 23*a* are energized, the scavenging throttle valves 20*a* are fully closed. The pair of scavenging throttle valves 20*b* of the second cylinder Cb are also linked to each other by a link 21*b* to which first and second solenoids 22*b* and 23*b* which operate in the same manner as the first and second solenoids 22*a* and 23*b* are coupled and a return spring 24*b* is coupled.

An exhaust throttle valve 30 is arranged in the exhaust manifold 11 and a vacuum actuator 31 is coupled to the exhaust throttle valve 30. When an atmosphere is introduced in a pressure chamber 310 of the vacuum actuator 31, the exhaust throttle valve 30 is kept fully opened by a spring 311, and when a vacuum is introduced to the pressure chamber 310, a diaphragm 312 is displaced to partially open the exhaust throttle valve 30 to throttle the exhaust manifold 11. One port 320 of a three-way solenoid valve 32 is connected to the pressure chamber 310 of the vacuum actuator 31 while the two remaining ports 321 and 322 of the three-way solenoid valve 32 are connected to the suction manifold 10 and an upstream end (air cleaner) of the carburettor 13, respectively. Thus, when the three-way solenoid valve 32 is not energized, an atmosphere is introduced into the pressure chamber 310 of the vacuum actuator 31, and when the valve 32 is energized, a vacuum from the suction manifold 10 is introduced.

A bypass passage 40 for bypassing between upstream and downstream ends of the throttle valve 12 is connected to the suction manifold 10, and a bypass passage switching valve (solenoid valve) 41 for opening and closing the bypass passage 40 is provided. When the solenoid valve 41 is not energized, it closes the bypass passage 40, and when it is energized it opens the bypass passage 40. When the bypass passage 40 is opened by the energization of the solenoid valve 41, the amount of intake air (air-fuel mixture) is increased more than the amount controlled by the throttle valve 12.

An ignition device 50 is connected to the spark plugs *6a* and *6b* of the cylinders Ca and Cb to cause spark discharge of the spark plugs *6a* and *6b* in synchronism with the rotation of the engine. A vacuum operated phase advancing device 52 is connected to an interrupter plate 510 of a distributor 51 of the ignition device 50, when an atmosphere is introduced into a vacuum chamber 520 of the vacuum operated phase advancing device 52, a relative position of an interrupter 512 to a cam shaft 511 is kept properly to assure an optimum ignition timing of the jump-spark ignition operation of the spark plugs *6a* and *6b*. When a vacuum is introduced into the vacuum chamber of the vacuum operated phase advancing device 52, a diaphragm 521 is displaced to rotate the interrupter plate 510 and hence the interrupter 512 relative to the cam shaft 511 to cause the spark plugs *6a* and *6b* to spark at forcibly advanced ignition timing. While the ignition device 50 includes an ignition coil and other elements, they are not shown in the drawing. A three-way solenoid valve 53 is connected to the vacuum operated phase advancing device 52 so that when the solenoid valve 53 is not energized, an atmosphere is introduced into the vacuum chamber 520 of the phase advancing device 52 and when it is energized a vacuum from the suction manifold is introduced.

A control circuit 60 is connected to the scanvenging throttle valve solenoids *22a, 22b, 23a* and *23b*, the exhaust throttle valve three-way solenoid valve 32, the bypass passage solenoid valve 41 and the ignition device three-way solenoid valve 53, to control the energization and deenergization of those valves in accordance with operation conditions of the engine.

A load detecting means (switch) 70 is provided in the throttle valve 12 to detect load condition of the operation conditions of the engine. The load detecting switch 70 is connected to the control circuit 60, and it has three switch mechanisms which are turned on and off in accordance with the aperture of the throttle valve 12. A movable terminal 700 which is common to the three switching mechanisms is rotated by the throttle valve 12. At an throttle aperture in a non-load condition of the engine, the movable terminal 700 is brought into contact with a first stationary terminal 701 to turn on the first switch. When the load slightly increases so that the throttle valve 12 is slightly opened, the movable terminal 700 is brought into contact with a second stationary contact 702 to turn on the second switch. When the load further increases so that the throttle valve 12 is further opened, the movable terminal 700 is brought into contact with a third stationary terminal 703 to turn on the third switch.

An engine r.p.m. detecting means 71 is mounted to a crank shaft 14 of the engine to detect the engine r.p.m. As best shown in FIG. 2, the engine r.p.m. detecting means 71 may comprise a rotor 710 with a magnet fixed to the crank shaft 14 and an electromagnetic pickup 711 arranged around the rotor 710. The electromagnetic pickup 711 is connected to a tachometer 712 to produces a voltage indicative of the engine r.p.m., which voltage is applied to the control circuit 60.

A warm-up detecting means (temperature sensing switch) 72 is mounted to a cylinder head *4a* to detect the warm-up condition of the engine, and a temperature sensing portion of the switch 72 is positioned in engine cooling water. The switch 72 is connected to the control circuit 60. The temperature sensing switch 72 is turned off (opened) in the warm-up condition of the engine at which the temperature of the cooling water is low, and it is turned on (closed) when the temperature of the cooling water exceeds a predetermined temperature.

A battery 74 is connected to the control circuit 60 through a key switch 73.

A circuit configuration of the control circuit is shown in FIG. 3. Connected in series with the three switches 701, 702 and 703, respectively, forming the load detecting switch are relay coils 600*a*, 610*a* and 620*a* of first, second and third relays 600, 610 and 620, respectively, which coils are connected in parallel with each other and connected in series with the temperature sensing switch 72 through the key switch 73. The energizations of the relay coils 600*a*, 610*a* and 620*a* of the first, second and third relays 600, 610 and 620 are controlled by the first, second and third switches 701, 702 and 703 respectively, and the temperature sensing switch 72. First and second comparators 630 and 640 are connected to the tachometer 712. Reference values for the comparators 630 and 640 are set by potentiometers 631 and 641, respectively, and transistors 632 and 642 are connected to the comparators 630 and 640, respectively. The reference values $n_1$ and $n_2$ of the comparators 630 and 640 are selected to be slightly higher than an idling r.p.m. of the engine with $n_1$ being smaller than $n_2$. In an experiment by the inventors, a satisfactory result was obtained when $n_1$ was equal to 1300 r.p.m. and $n_2$ was equal to 1800 r.p.m. A fourth relay 650 is connected to the first transistor 632 and a fifth relay 660 is connected to the second transistor 642 to control the energizations of the relay coils 650*a* and 660*a* thereof. A relay coil 670*a* of a sixth relay 670 is connected to relay switches 600*b*, 610*b* and 620*b* of the first, second and third relays 600, 610 and 620, respectively. Numeral 680 denotes a known constant voltage circuit.

Other relay switches (relay contacts) 600*c* to 600*h* of the first relay coil 600 are connected to the solenoids *23a*, 41, *22b, 23b, 22a* and 53, respectively, and another relay switch (relay contact) 610*c* of the second relay 610 is connected to the solenoid 53 while another relay contact 620*b* of the third relay 620 is connected to the solenoid *22b*. The relay contacts 600*b* to 600*h*, 610*b*, 610*c*, 620*b* and 620*c* of the first, second and third relays 600, 610 and 620 are all normally open contacts, which are closed when the corresponding relay coil 600*a*, 610*a* or 620*a* is energized.

A normally open relay contact 650*b* of the fourth relay 650 is connected to the relay contact 600*b* of the first relay 600 while a normally close relay contact 650*c* is connected to a normally open relay contact 660*f* of the fifth relay 660.

Relay contacts 660*b*, 660*c*, 660*e* and 660*f* of the fifth relay 660 are connected to the relay contacts 600*d*, 600*g*, 600*c* and 600*h*, respectively, of the first relay 660, and relay contacts 660*d* and 660*g* are connected to the relay contacts 610*b* and 610*c*, respectively, of the second relay 610.

The relay contacts 660*b*, *660d*, 660*f* and 660*g* of the fifth relay 660 are normally open contacts while the relay contacts 660c and 660e are normally close contacts.

The solenoid 32 is connected to the relay contacts 600b, 610b and 620c while the solenoid 22a is connected to the normally open relay contact 670b of the sixth relay 670 as well as the contact 600g of the first relay 600.

The operation of the first embodiment of the present invention thus constructed is now explained. Since the operation mode of the present invention changes depending on the switched position of the temperature sensing switch 72, the aperture of the throttle valve 12, that is, the switched position of the load detecting switches 701 to 703 and the engine r.p.m. the operation modes are classified to an operation mode I where the temperature sensing switch 72 is turned off (opened) and operation modes II to XIII where the teperature sensing switch 72 is turned on (closed) and the load detecting switch and the engine r.p.m. assume the conditions as defined by a chart of FIG. 4, and the operation of the embodiment is explained for each operation mode.

The operated or actuated conditions of the scavenging throttle valves 20a and 20b, the exhaust throttle valve 30, the bypass passage switching valve 41 and the three-way solenoid valve 53 or the vacuum operated phase advancing device 52, the combustion conditions and the ignition timings of the first and second cylinders Ca and Cb are shown in the chart of FIG. 5 for each operation mode of the engine. Therefore, reference is also made to FIG. 5 in the following explanation of the operation.

Operation Mode I (Warm-up Operation)

In the warm-up operation of the engine, since the temperature of the cooling water is low, the temperature sensing switch 72 is turned off (opened) to deenergize all of the first, second and third relays 600, 610 and 620 to deenergize all of the solenoids 22a, 22b, 23a and 23b for the scavenging throttle valves, the three-way solenoid valve 32 of the exhaust throttle valve, the solenoid valve 41 for the bypass passage 40 and the three-way solenoid valve 53 of the ignition device 50. All of the scavenging throttle valves 20a and 20b of the cylinders Ca and Cb are fully opened to introduce an atmosphere into the pressure chamber 310 of the vacuum actuator 31 for the exhaust throttle valve to fully open the exhaust throttle valve 30 and close the bypass passage 40. An atmosphere is introduced into the vacuum chamber 520 of the vacuum operated phase advancing device 52 of the ignition device 50 to establish an optimum ignition timing for the jump-spark ignition operation to the spark plugs 6a and 6b. In this manner, the jump-spark ignition operation is carried out by the spark plugs 6a and 6b in the cylinders Ca and Cb so that normal 2-cycle engine operation is conducted to smoothly warm up the engine.

Operation Mode II (Non-load Operation)

After the engine has been warmed up, the temperature sensing switch 72 is turned on (closed). In the non-load operation of the engine, the first switch 701 of the load detecting switch 70 is turned on (closed) to energize the first relay 600 to turn on all of the seven normally open relay switches 600b to 600h. In this case, since the engine r.p.m. is lower than any of the reference values $n_1$ and $n_2$ of the first and second comparators 630 and 640, the first and second transistors 632 and 642 are both turned on to energize the fourth and fifth relays 650 and 660. As a result, the normally open relay switch 650b of the fourth relay 650 is turned on (closed), the normally closed relay switch 650c is turned off (opened), the four normally open switches 660b, 660d, 660f and 660g (shown by circles) of the fifth relay 660 are turned on and the two normally closed relay switches 660c and 660e (shown by dots) are turned off. In this case, the sixth relay 670 is also energized. In the first cylinder Ca, the first solenoid 22a for the scavenging throttle valve is energized and the second solenoid 23a is not energized to partially open the scavenging throttle valves 20a to throttle the scavenging passages 8a. In the second cylinder Cb, the first and second solenoids 22b and 23b for the scavenging throttle valves are both energized to fully close the scavenging throttle valves 20b to close the scavenging passages 8b. Furthermore, the three-way solenoid valve 32 for the exhaust throttle valve is energized to introduce the suction manifold vacuum to the vacuum actuator 31 to partially open the exhaust throttle valve 30 to throttle the exhaust manifold 11 (exhaust passages 9a and 9b). In addition, the solenoid valve 41 for the bypass passage 40 is energized to open the bypass passage 40. The three-way solenoid valve 53 for the ignition circuit 50 is left unenergized.

Thus, in the non-load operation of the engine, the air-fuel mixture combustion occurs in the first cylinder Ca while the scavenging passages 8a and the exhaust passage 9a (exhaust manifold 11) are both throttled, and the combustion is stopped in the second cylinder Cb by stopping the feeding of gas by fully closing the scavenging throttle valves 20b. In this case, increased amount of gas, which is larger than the quantity controlled by the throttle valve 12 is fed to the first cylinder Ca by opening the bypass passage 40 so that the cylinders Ca and Cb are operated by the combustion in the first cylinder Ca. in this case, a gas feed ratio of 0.2 to 0.4 in the first cylinder Ca is preferable.

According to the operation described above, since the scavenging flow and the exhaust flow are both throttled in the first cylinder Ca, the newly supplied gas (fresh air-fuel mixture) gently flows into the combustion chamber 5a and the exhaust flow is also suppressed. Accordingly, the gas flow in the combustion chamber 5a is gentle and no substantial blow-out of the newly supplied gas is observed and the newly supplied gas is mixed with the residual gas of the previous cycle. The newly supplied gas is heated by a heat energy of the residual gas and further heated during the compression and decomposed into several radicals (CH, $C_2$, etc.), which are intermediate products which promote the combustion reaction and are spontaneously ignited around the end of the compression stroke. Namely, a kind of run-on phenomenon takes place and the combustion under this condition is very stable and free from misignition.

In this manner, in the non-load condition where the speed is low and the gas feed ratio is usually low, the compression ignition combustion takes place in selected ones of the cylinders to prevent the disordered combustion and the blow-out of the newly supplied gas. The fact that the scavenging passages 8a are arranged not to oppose to the exhaust passage 9a also contributes to prevent the blow-out of the fresh mixture. The amount of exhaust of HC can be reduced by the factor of approximately 10 to compare with a conventional engine.

The combustion efficiency is, of course, materially improved.

Operation Mode III

When the throttle valve 12 is gradually opened to accelerate the engine, the first switch 701 is turned off at a throttle aperture which is slightly larger than that in the non-load condition and the second switch 702 is instead turned on to energize the second relay 610. In this case, since the engine r.p.m. is lower than the reference $n_1$ of the first comparator 630, the fourth and fifth relays 650 and 660 both remain energized. Thus, the three-way solenoid valve 32 for the exhaust throttle valve remains energized to keep the exhaust manifold 11 throttled. The sixth relay 670 is energized while only the first solenoid 22*a* of the scavenging throttle valve in the first cylinder Ca is energized to throttle the scavenging passages 8*a*. In the second cylinder Cb, however, the solenoids 22*b* and 23*b* for the scavenging throttle valves are both deenergized to fully open the scavenging throttle valves 20*b*. In this case, therefore, the compression ignition operation is maintained in the first cylinder Ca while normal jump-spark ignition operation takes place in the second cylinder Cb. In this case, by energizing the second relay 610 and the fifth relay 660, the three-way solenoid valve 53 for the ignition device 50 is energized to introduce the suction manifold vacuum to the vacuum operated phase advancing device 52 of the ignition device 50. The ignition timing of the spark plugs 6*a* and 6*b* are forcibly advanced and the jump-spark ignition operation is carried out in the second cylinder Cb at the advanced ignition timing.

Operation Mode IV (Low-load Operation)

As the throttle valve 12 is further opened to reach the throttle aperture for the low load operation, the third switch 703 is turned on to energize the third relay 620. As a result, the sixth relay 670 is also energized so that the first solenoids 22*a* and 22*b* for the scavenging throttle valves in the cylinders Ca and Cb are energized to throttle the scavenging passages 8*a* and 8*b* of the cylinders Ca and Cb. The three-way solenoid valve 32 for the exhaust throttle valve is also energized to throttle the exhaust manifold 11. In this manner, the compression ignition combustion is carried out in the cylinders Ca and Cb to prevent both the disordered combustion and the blow-out of the newly supplied gas.

In shifting to the compression ignition operation in the cylinders Ca and Cb in the low load operation, the second cylinder Cb in which the combustion has been stopped in the non-load operation temporarily carries out the jump-spark ignition operation at the forcibly advanced ignition timing. Since the ignition time in the compression ignition operation is usually earlier than that in the jump-spark ignition operation, the shift of operation from the non-load operation to the low load operation in the second cylinder Cb takes place very smoothly by the virture of the jump-spark ignition operation at the advanced ignition timing.

Operation Mode V (Normal Running Operation)

When the aperture of the throttle valve 12 reaches the aperture of normal load operation, all of the switches 701, 702 and 703 of the load detecting switch 70 are turned off so that the normal jump-spark ignition operation is carried out in the both cylinders Ca and Cb like in the case of warm-up operation. In this case, since the three-way valve 53 for the ignition device is not energized, the ignition timing is kept at a normal timing which is optimum to the jump-spark operation to assure a desired output.

Operation Mode VI (Deceleration)

When the engine is decelerated from a high speed operation, since the engine r.p.m. is higher than the reference $n_2$ of the second comparator 640, the first and second transistors 632 and 642 are both turned off to denergize the fourth and fifth relays 650 and 660. The first switch 701 of the load detecting switch is turned on to energize the first relay 600. As a result, both the solenoids 22*a* and 23*a* for the scavenging throttle valve of the first cylinder Ca are energized by the normally close relay switch of the fifth relay 660 and the both solenoids 22*b* and 23*b* of the scavenging throttle valve of the second cylinder Cb are energized. The scavenging passages 8*a* and 8*b* of the cylinders Ca and Cb are thus fully closed to stop the feed of the air-fuel mixture to the cylinders Ca and Cb to effect a so-called fuel cut. In this manner, the deceleration operation can be carried out smoothly and the fuel can be saved. In this case, the exhaust throttle valve 30 is fully opened while the bypass passage 40 is closed.

Operation Mode VII (Deceleration)

As the engine r.p.m. decreases by the stop of the feed of air-fuel mixture of the cylinders Ca and Cb, the second transistor 642 is turned on when the engine r.p.m. decreases below the reference $n_2$ of the second comparator 640, to energize the fifth relay 660. As a result, the scavenging throttle valves 20*b* of the second cylinder Cb is kept fully closed while both of the solenoids 22*a* and 23*a* for the scavenging throttle valve of the first cylinder Ca are deenergized to fully open the scavenging throttle valves 20*a* so that the normal jump-spark ignition combustion takes place in the first cylinder Ca. In this case, the three-way solenoid valve 53 for the ignition device is energized through the normally close switch 650*c* of the fourth relay 650, the switch 660*f* of the sixth relay 660 and the switch 600*h* of the first relay 600, to forcibly advance the ignition timing. As a result, the jump-spark ignition operation takes place in the first cylinder at the forcibly advanced ignition timing. In this case, the solenoid valve 41 for the bypass passage 40 is energized to open the bypass passage 40 to feed an increased amount of gas to the first cylinder Ca. The passage area of the bypass passage 40 is designed such that the engine r.p.m. in the non-load condition by the operation of only the first cylinder Ca with the bypass passage 40 being opened in equal to that in the normal operation by the both cylinders. Accordingly, the engine r.p.m. is finally decreased below the reference $n_1$ of the first comparator 630 and the operation is shifted to the compression ignition operation by the first cylinder Ca in the non-load condition described above.

In shifting to the non-load operation by the deceleration of the engine, the operation mode of the first cylinder Ca is shifted from the stop of the feed of air-fuel mixture to the compression ignition operation, wherein the jump-spark ignition operation is temporarily carried out in the shifting operation in the first cylinder Ca at the advanced ignition timing, as described above. As a result, the shift of the operation in the first cylinder Ca from the low load operation to the non-load operation is carried out smoothly like in the case of the shift from the non-load operation to the low load operation.

Operation Mode VIII (Rapid Acceleration)

When the throttle valve 12 is opened largely to rapidly accelerate the engine from the non-load or low load operation (operation modes II to IV), all of the switches 701, 702 and 703 of the load detecting switch 70 are opened so that the normal jump-spark ignition operation takes place in both of the cylinders Ca and Cb. Therefore, smooth acceleration is attained.

The operation mode VIII is similar to the operation mode V described above, and the symbol V in the parentheses in FIG. 4 indicates that the operation is the same as that of the operation mode V. An operation mode IX is also a rapid acceleration operation mode which is again the same as the operation mode V as seen from FIGS. 4 and 5.

Operation Modes X to XIII (Transitional Operation)

The operation modes X to XIII are transitional operation modes which occur between the non-load operation and the normal operation. The actuated conditions of the respective valves 20*a*, 20*b*, 30, 41 and 53 are shown in FIG. 5. As shown in the parentheses in FIG. 4, the mode X is the same as the mode III, the modes XI and XIII are the same as the mode IV, and the mode XII is the same as the mode V.

When the key switch 73 is turned off to stop the engine, the scavenging throttle valves 20*a* and 20*b* of the both cylinders Ca and Cb are fully opened and the exhaust throttle valve 30 is fully opened, like in the case of the warm-up operation and the normal load operation, to prevent the compression ignition combustion (run-on) after the turn-off of the key switch 73 to assure reliable stop of the engine.

As described above, according to the operation method of the first embodiment of the present invention, the compression ignition operation takes place in the non-load operation and the low load operation to prevent the disordered combustion and the blow-out of the newly supplied gas to effectively improve the purification of the exhaust gas and the combustion efficiency. In the warm-up operation and the normal load operation, the jump-spark ignition operation takes place in both of the cylinders to smoothly conduct the warm-up operation and the load operation. In the deceleration operation, the supply of fuel to both of the cylinders is stopped to effectively decelerate the engine. In shifting to the compression ignition operation, the jump-spark ignition operation is conducted with the forcibly advanced ignition timing to attain smooth shift of operation mode.

In the first embodiment of the present invention described above, the compression ignition (run-on) in the selected one of the cylinders in the non-load operation is important, and the normal combustion operation of all of the cylinders in the normal load condition is also important. The run-on operation of all of the cylinders in the low load condition and the fuel-cut operation in the deceleration, however, are not always necessary depending on the type of the engine and they may be omitted to simplify the construction of the control system and promote the practicability.

Second Embodiment

Figure 6:
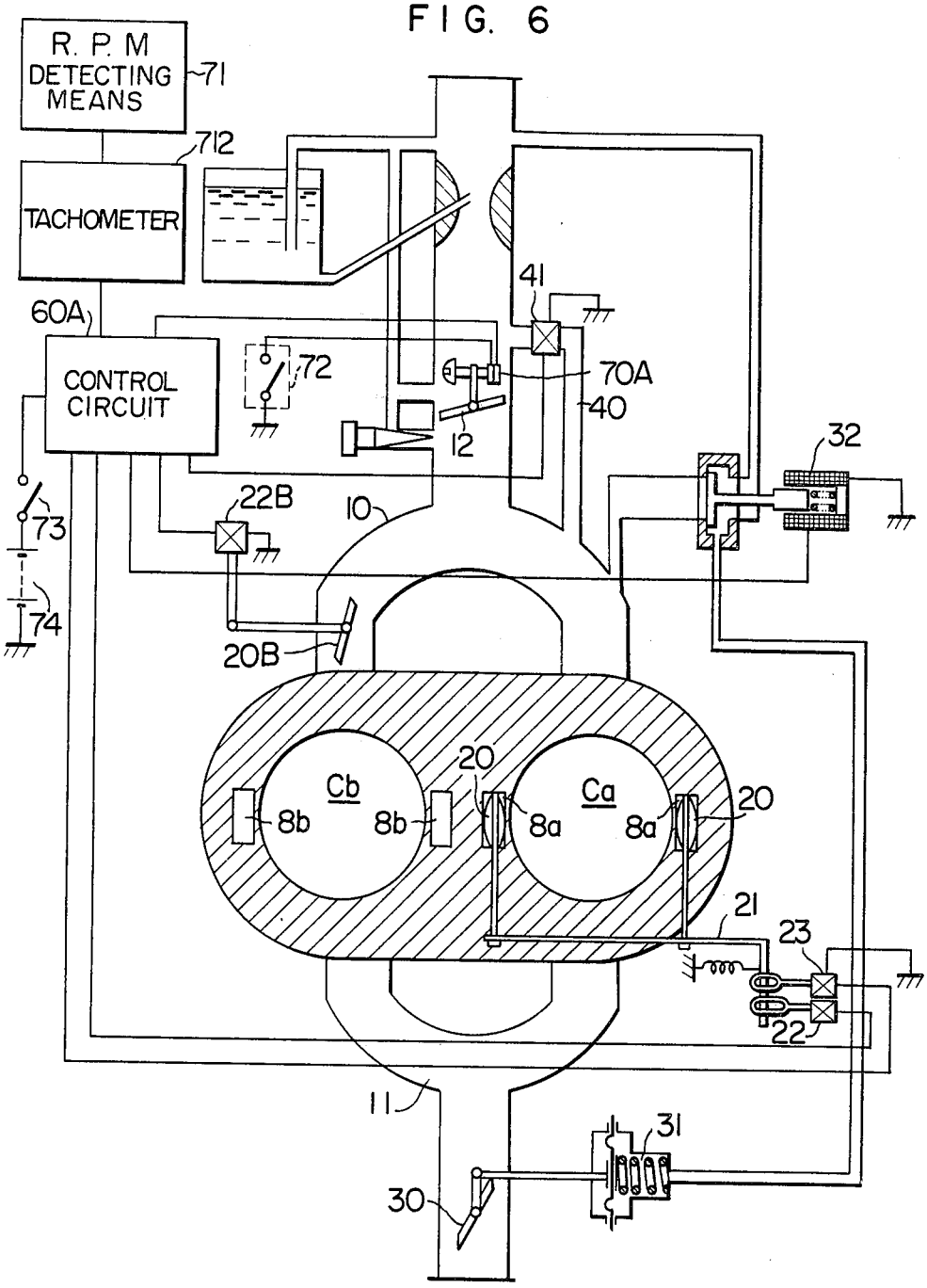
FIG. 6 shows a configuration illustrating a second embodiment of the present invention.
Figure 7:
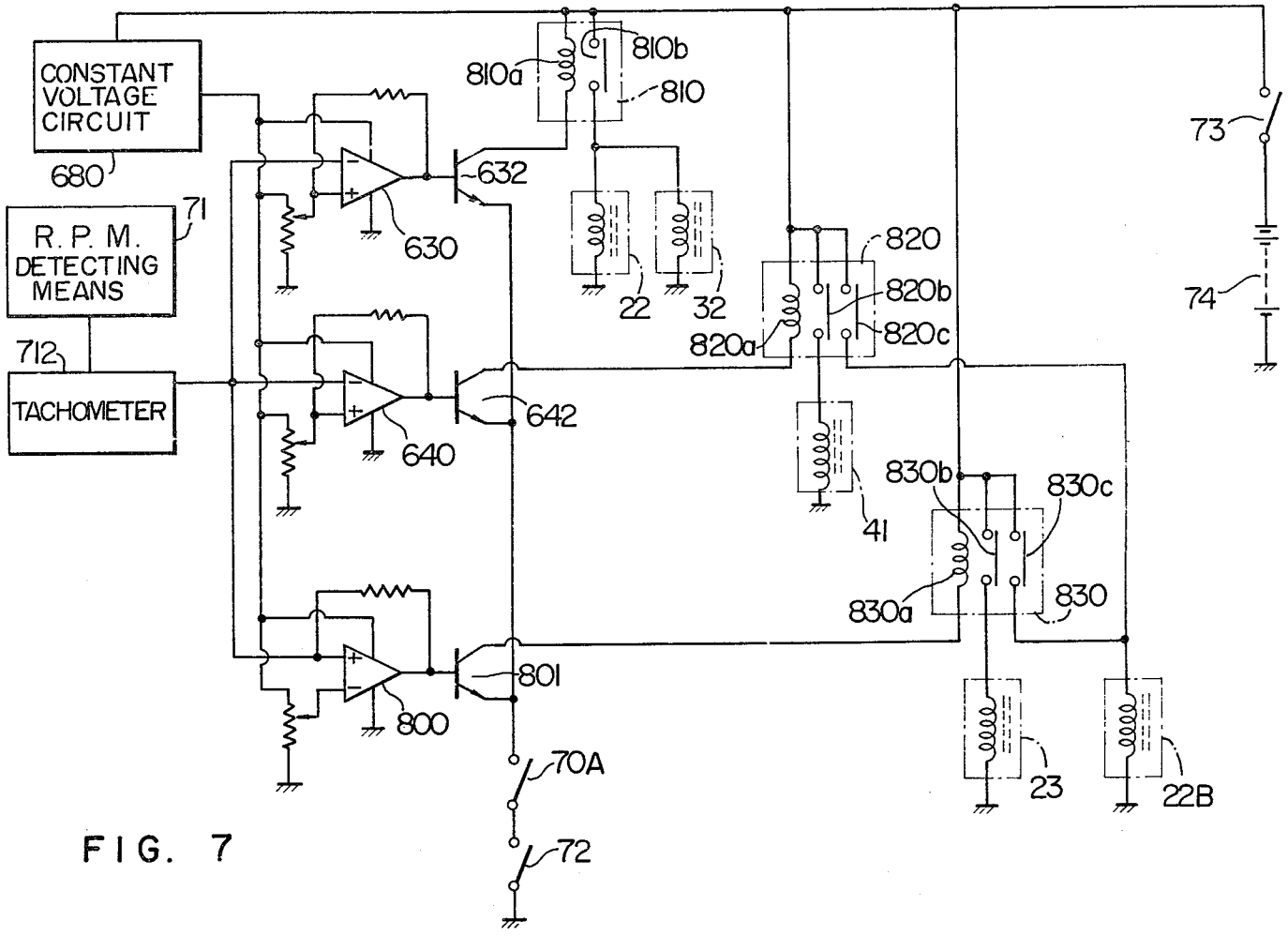
FIG. 7 shows a circuit diagram illustrating detail of a control circuit of the second embodiment.

In a second embodiment shown in FIGS. 6 and 7, the run-on combustion operation of all of the cylinders in the low load condition is omitted. As a result, a switching valve 20B is provided in a branch passage (suction passage) of the suction manifold 10 in the second cylinder Cb instead of the scavenging passages 8*b*, and a solenoid 22B is coupled to the switching valve 20B. When the solenoid 22B is energized, the switching valve 20B is fully closed and when the solenoid 22B is deenergized, the switching valve 20B is fully opened. In the first cylinder Ca, the scavenging throttle valves 20 are provided in scavenging passages 8*a* and the valves 20 are linked together by the rod 21 to which two solenoids 22 and 23 are coupled. When the first solenoid 22 is energized, the scavenging throttle valves 20 are partially opened to throttle the scavenging passages 8*a*, and when the second solenoid 23 is energized, the scavenging throttle valves 20 are fully closed. When the solenoids 22 and 23 are both deenergized, the scavenging throttle valves 20 are fully opened. The load detecting switch 70A is turned on (closed) only when the aperture of the throttle valve 12 reaches the aperture in the non-load operation (substantially fully closed), and turned off (opened) during other states. The exhaust throttle valve 30, the vacuum actuator 31, the three-way solenoid valve 32, the bypass passage 40, the solenoid valve 41, the engine r.p.m. detecting means 71, the tachometer 712 and the temperature sensing switch 72 are the same as those in the first embodiment.

A control circuit 60A is constructed as shown in FIG. 7, in which the first and second comparators 630 and 640 and the transistors 632 and 642 connected to the output terminals thereof are identical to those shown in the first embodiment (FIG. 3). As the output voltage of the tachometer 712 indicative of the engine r.p.m. exceeds the respective reference voltages, the outputs of the comparators change from "1" to "0" to turn off the transistors 632 and 642.

In the second embodiment, in addition to the first and second comparators, the third comparator 800 is connected to the tachometer 712. Since a positive input terminal of the comparator 800 is connected to the tachometer 712, the output of the comparator 800 changes from "0" to "1" when the engine r.p.m. exceeds the reference, to turn on a transistor 801 connected to the output of the comparator 800. In the present embodiment, the reference of the third comparator 800 is selected to be equal to the reference of the second comparator 640. Accordingly, when the engine r.p.m. N is lower than the reference $n_2$, the output of the comparator 800 is "0".

The emitters of the transistors 632, 642 and 801 are grounded through the load detecting switch 70A and the temperature sensing switch 72, respectively. The collectors of the transistors 632, 642 and 801 are connected to the battery 74 through a relay coil 810*a* of a first relay 810, a relay coil 820*a* of a second relay 820 and a relay coil 830*a* of a third relay 830, respectively. Accordingly, when the transistor 632, 642 or 801 is turned on, the corresponding relay coil 810*a*, 820*a* or 830*a* is energized to close the corresponding normally open relay contact. A relay contact 810*b* of the first relay 810 is connected to the solenoids 22 and 32. A relay contact 820*b* of the second relay 820 is connected to the solenoid 41 and a relay contact 820*c* is connected to the solenoid 22B. A relay contact 830*b* of the third relay 830 is connected to the solenoid 23 and a relay contact 830*c* is connected to the solenoid 22B.

The operation of the second embodiment of the present invention thus constructed is now explained. Like in the case of the first embodiment, the operation modes are classified as shown in FIG. 8 by the actuated conditions of the temperature sensing switch 72 and the load detecting switch 70A and the engine r.p.m. The actuated conditions of the respective valves are shown in FIG. 9 for each operation mode. Thus, the explanation of the operation is made with reference to FIGS. 8 and 9.

The operation mode I is a warm-up operation in which the temperature sensing switch 72 is opened.

Operation Mode I (Warm-up Operation)

When the temperature of the cooling water for the engine is below the reference, the temperature sensing switch 72 is opened so that the transistors 632, 642 and 801 are not turned on. Thus, the solenoids 22, 23, 32, 41 and 22B are all not energized, and the valves 20, 30 and 20B are fully opened while the valve 41 is closed. As a result, the normal jump-spark ignition operation takes place in both of the cylinders Ca and Cb so that the warm-up operation is smoothly carried out.

Operation Mode II (Non-load Operation)

In the non-load operation of the engine after the warm-up operation of the engine, the temperature sensing switch 72 and the load detecting switch 70A are both closed so that the first and second transistors 632 and 642 are turned on while the third transistor 801 remains non-conductive. Accordingly, the relay coils **810*a* and 820*a* of the first and second relays are energized to close the contacts 810*b*, 820*b* and 820*c*. As a result, all solenoids 22, 32, 41 and 22B but the solenoid 23 are energized so that the switching valve 20B is fully closed, the scavenging throttle valves 20 and the exhaust throttle valve 30 are throttled and the bypass passage switching valve 41** is opened. Accordingly, the compression ignition combustion takes place in the first cylinder Ca while the combustion operation is stopped in the second cylinder Cb.

Operation Mode III (Normal Operation)

In the normal load operation, since the load detecting switch 70A is opened, all of the solenoids are deenergized and the normal jump-spark ignition combustion takes place in both of the cylinders Ca and Cb.

Operation Mode IV (Deceleration)

In the deceleration of the engine ($N > n_2$), snce the load detecting switch 70A is closed, the third transistor 801 is turned on so that the relay coil **830*a* of the third relay is energized. As a result, the relay contacts 830*b* and 830*c* are closed so that the solenoids 23 and 22B are energized. Since the scavenging throttle valves 20 and the switching valve 20B** are both fully closed, the supply of fuel is stopped so that the combustion operation in the cylinders Ca and Cb is stopped.

Operation Mode V (Deceleration)

As the engine r.p.m. decreases in the deceleration mode and the engine r.p.m. N falls below the reference $n_2$ of the second and third comparators 640 and 800 (but still higher than the reference $n_1$), the switching valve 20B of the second cylinder Cb remains fully closed but the scavenging throttle valves 20 of the first cylinder Ca is fully opened by the turn-off of the third transistor 801 and the turn-on of the second transistor 642, and the bypass passage 40 is opened. As a result, the first cylinder Ca is shifted to the normal operation so that the shift to the compression ignition combustion in the non-load operation is smoothly carried out.

Operation Modes VI and VII (Acceleration)

In the rapid acceleration of the engine, since the throttle valve 12 is opened largely and the load detecting switch 70A is opened, the normal jump-spark ignition combustion takes place in the both cylinders Ca and Cb.

As described above, in the second embodiment, the compression ignition combustion of all of the cylinders in the low load operation is not carried out but the compression ignition combustion is carried out in one of the cylinders in the non-load condition and the combustion in the other cylinder is stopped. In this manner, the disordered combustion can be prevented.

While the ignition device which can vary the ignition timing may be used, the explanation thereof is not described herein.

Third Embodiment

Figure 10:
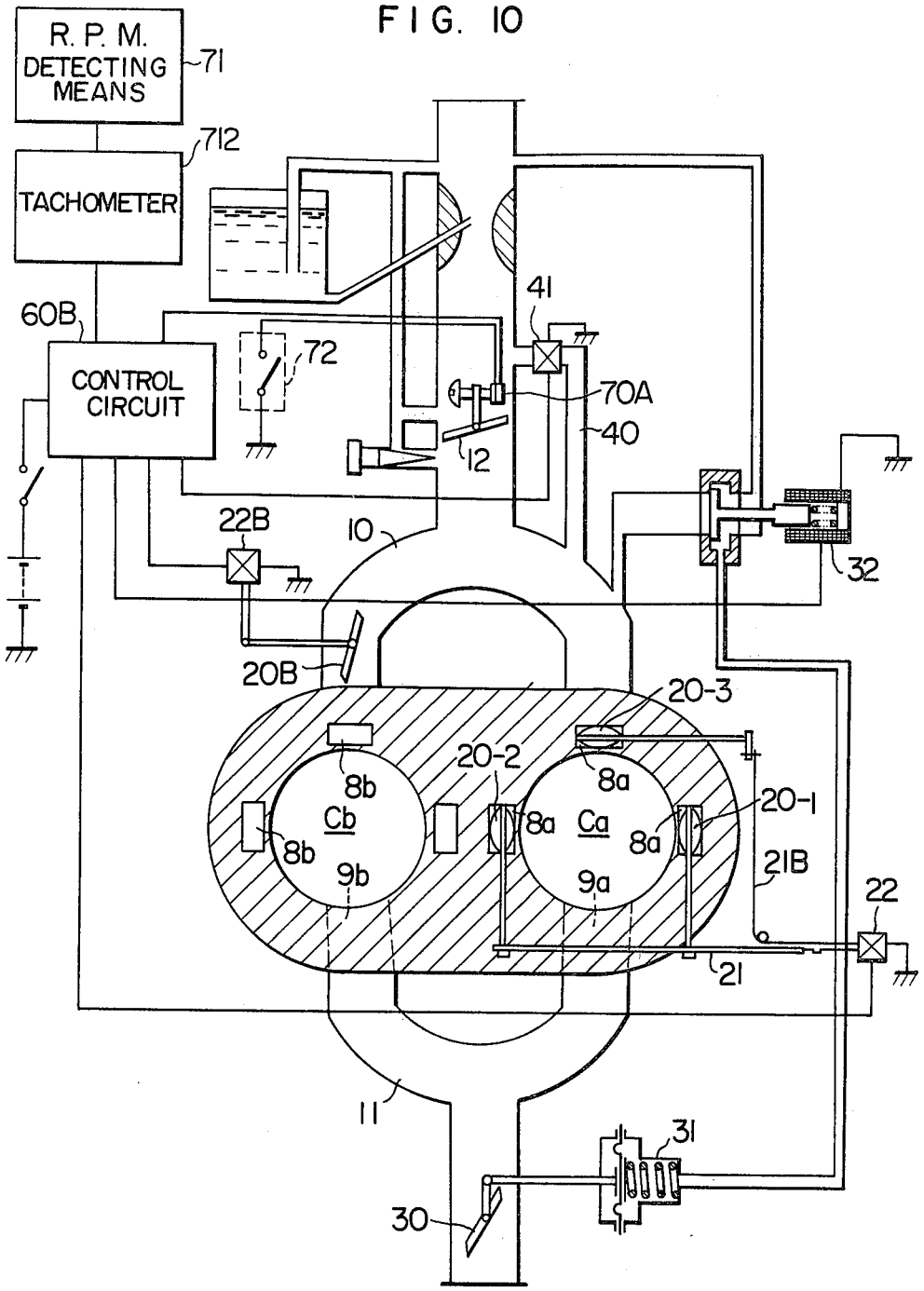
FIG. 10 shows a configuration illustrating a third embodiment of the present invention.

In the second embodiment described above, the scavenging throttle valves 20 and the switching valve 20B are fully closed in the deceleration mode of the engine (operation mode IV) to stop the supply of fuel. In the third embodiment to be described, the run-on combustion of all of the cylinders in the low load operation of the engine as well as the fuel cut in the deceleration operation are omitted to further simplify the control system. Referring now to FIG. 10, the construction of the third embodiment, particularly the difference from that of the second embodiment is explained. Each cylinder has three scavenging passages **8*a* and 8*b*, one of which is arranged to face to the exhaust passage 9*a* or 9*b*. In the second cylinder Cb, the switching valve 20B is provided in the branch of the suction passage 10 like in the second embodiment and the solenoid 22B is coupled to the switching valve 20B. In the first cylinder Ca, the scavenging throttle valves is provided in each of the three scavenging passages 8*a*. Of the three scavenging throttle valves, two scavenging throttle valves 20-1 and 20-2, which are arranged in the passages which do not face to the exhaust passage 9*a* are directly linked together by the link 21 while the throttle valve 20-3 arranged in the scavenging passage 8*a* which faces to the exhaust passage 9*a* is linked with play by a link 21B. When the two scavenging throttle valves 20-1 and 20-2 are fully opened, the third scavenging throttle valve 20-3 is also fully opened, but when the two valves 20-1 and 20-2 are partially opened the valve 20-3 is fully closed (or partially opened). The solenoid 22 is coupled to the link 21, and when the solenoid 22 is not energized, all of the scavenging throttle valves 20-1, 20-2 and 20-3 are kept fully open, and when the solenoid 22 is energized, the two scavenging throttle valves 20-1 and 20-2 are partially opened to throttle two of the scanvenging passages 8*a* while the third scavenging throttle valve 20-3 is fully closed (or partially opened) by the link 21B to fully close (or partially open) the remaining scavenging passage 8*a* which faces to the exhaust passage 9*a*. The exhaust throttle valve 30, the vacuum actuator 31, the three-way solenoid valve 32, the bypass passage 40, the solenoid valve 41, the load detecting switch 70A, the engine r.p.m. detecting means 71 and the tachometer 712** are identical to those shown in the second embodiment.

Figure 11:
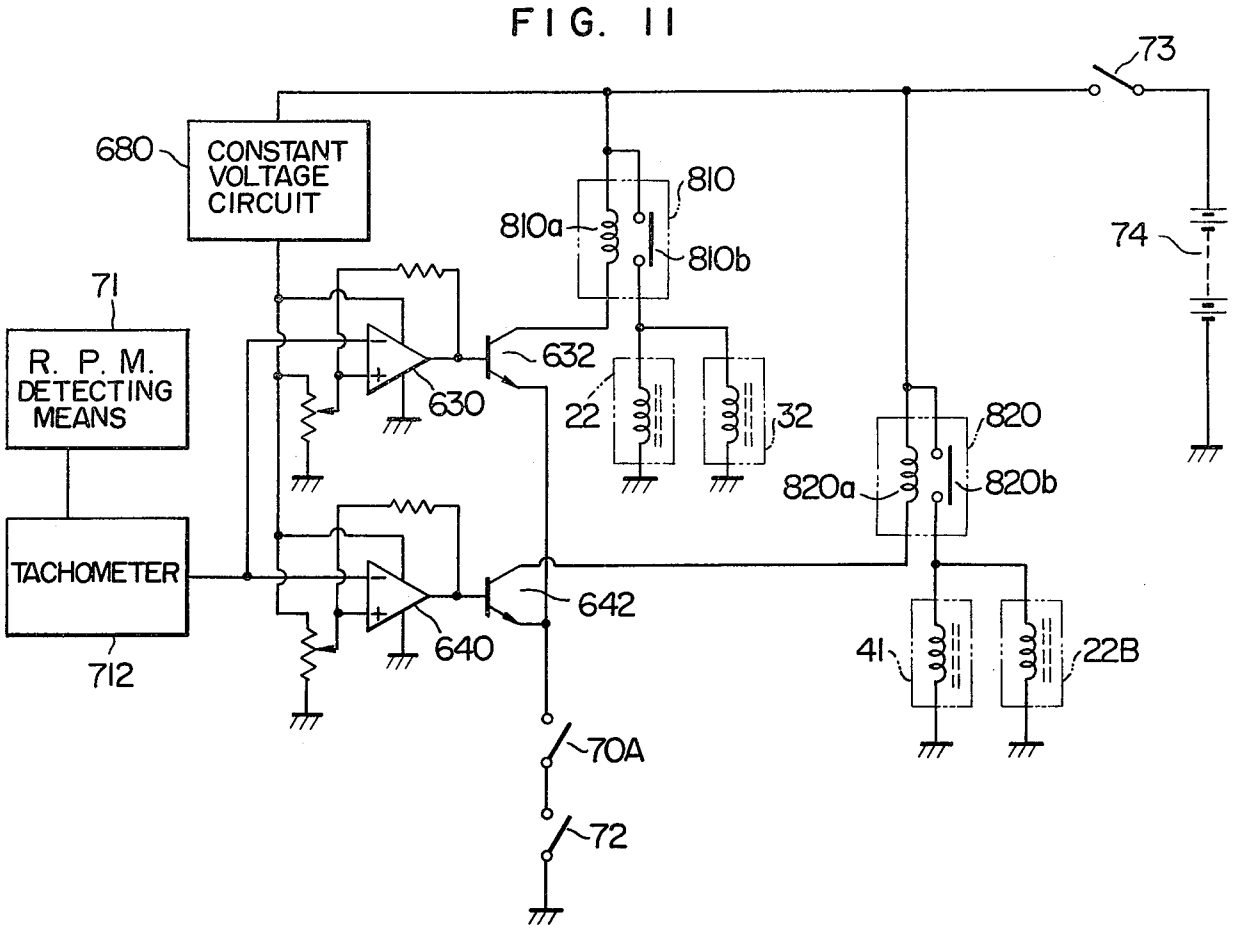
FIG. 11 shows a circuit diagram illustrating a control circuit of the third embodiment.

A control circuit 60B of the third embodiment is shown in FIG. 11. As is apparent from the comparison with the control circuit 60A (FIG. 7) of the second embodiment, the third comparator 800, the third transistor 801, the third relay 830 and the solenoid 23 in the control circuit of FIG. 7 have been eliminated in the control circuit of FIG. 11. The remaining portions shown in FIG. 11 are identical to those in FIG. 7.

The operation of the third embodiment is now explained. Again, in the third embodiment, the operation modes are classified by the actuated conditions of the temperature sensing switch 72 and the load detecting switch 70A and the engine r.p.m. The actuated conditions of the respective valves are shown in FIG. 12 for each operation mode. The explanation of the operation is therefore made with reference to FIG. 12, too.

The operation modes are classified as shown in FIG. 8 like in the case of the second embodiment, and the operation mode I is a warm-up operation of the engine is which the temperature sensing switch 72 is opened.

Operation Modes I, III, VI and VII

In the warm-up operation of the engine, the normal load operation and the rapid acceleration operation, since either one of the temperature sensing switch 72 and the load detecting switch 70A is opened, the scavenging valves 20-1 to 20-3, the switch valve 20B and the exhaust throttle valve 30 are all fully opened and the passage switching valve 41 is closed. Therefore, the normal jump-spark ignition combustion takes place in the cylinders Ca and Cb. Accordingly, the warm-up operation, the normal load operation or the rapid acceleration of the engine can be carried out smoothly.

Operation Mode II (Non-load Operation)

In the non-load operation after the engine has been warmed up, since the switches 70A and 72 are both closed and the outputs of the first and second comparators 630 and 640 are both "1", the transistors 632 and 642 are both turned on. As a result, the relay coils **810*a* and 820*a* of the first and second relays are energized so that the solenoids 22, 32, 41 and 22B** are all energized.

As a result, the two scavenging throttle valves 20-1 and 20-2 of the first cylinder Ca are partially opened, the third scavenging throttle valve 20-3 is fully closed (or partially opened) and the switching valve 20B of the second cylinder Cb is fully closed. The exhaust throttle valve 30 is partially opened and the bypass passage switching valve 41 is opened. Accordingly, the compression ignition combustion takes place in the first cylinder (combustion chamber) Ca while the combustion operation is stopped in the second cylinder (combustion chamber) Cb, so that the disordered combustion in the non-load operation of the engine is prevented. In case of the compression ignition combustion in the first cylinder Ca, the third scavenging throttle valve 20-3 provided in the scavenging passage facing to the exhaust passage **9*a*** is fully closed (or partially closed). Accordingly, the blow-out of the newly supplied gas can be fully prevented.

Operation Modes IV and V (Deceleration)

In the deceleration operation of the engine, the load detecting switch 70A is closed. However, when the engine r.p.m. N is higher than the references $n_1$ and $n_2$ (operation mode IV), the outputs of the first and second comparators 630 and 640 are both "0". Accordingly, the first and second relays are not energized and the normal jump-spark ignition combustion takes place in the both cylinder Ca and Cb.

As the engine is decelerated so that the engine r.p.m. N falls below the reference $n_2$ (operation mode V), the output of the second comparator 640 changes from "0" to "1". Thus, the transistor 642 is turned on to energize the relay coil **820*a* of the second relay 820. As a result, solenoids 41 and 22B are energized so that the switching valve 20B is fully closed and the bypass passage switching valve 41** is opened. Thus, the combustion operation is stopped (fuel cut) in the second cylinder Cb while the normal jump-spark ignition combustion takes place in the first cylinder Ca.

While the method for controlling the ignition timing is not explained in conjunction with the third embodiment, any appropriate ignition device may be used.

Fourth Embodiment

In the first to third embodiments described above, a butterfly type valves are used as the scavenging throttle valves 20 arranged in the scavenging passages **8*a* and 8*b***. However, the scavenging throttle valves need not be limited to the butterfly type valves but they may be rotary plate type valves as will be explained hereinbelow.

Figure 13:
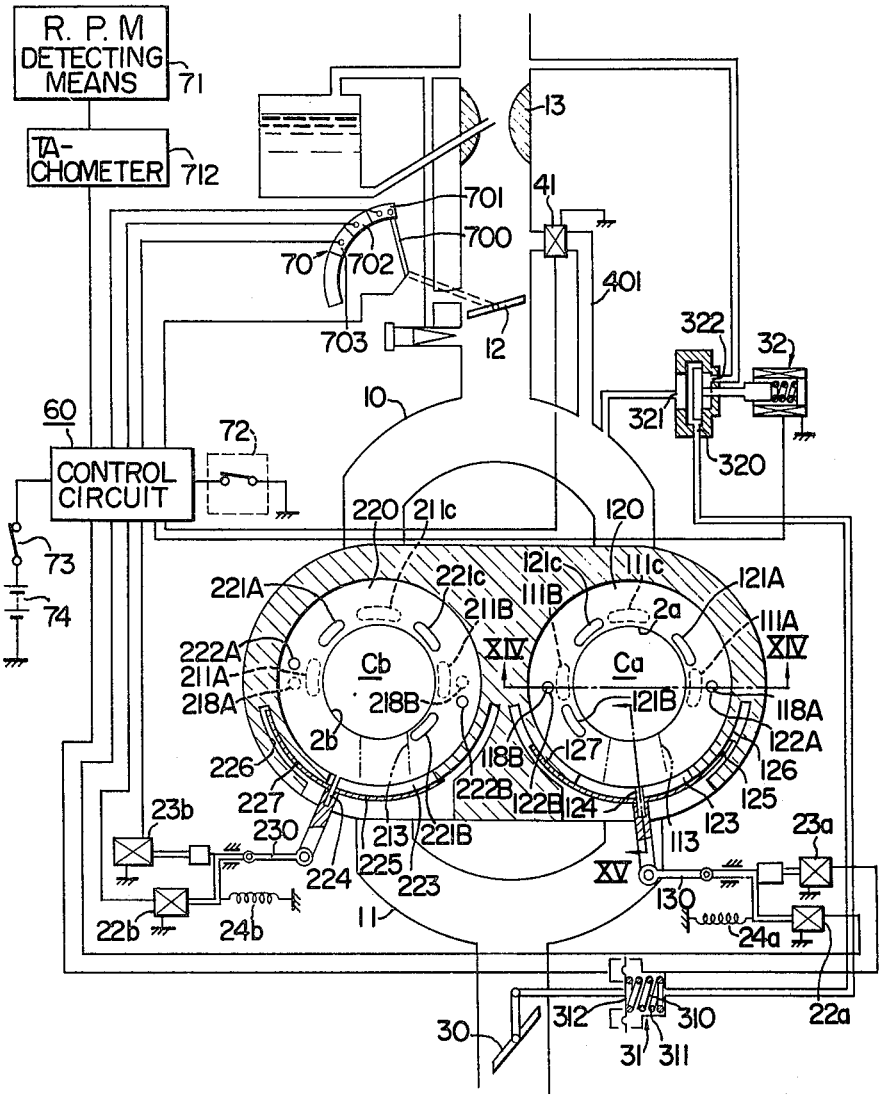
FIG. 13 shows a configuration illustrating a fourth embodiment of the present invention.
Figure 14:
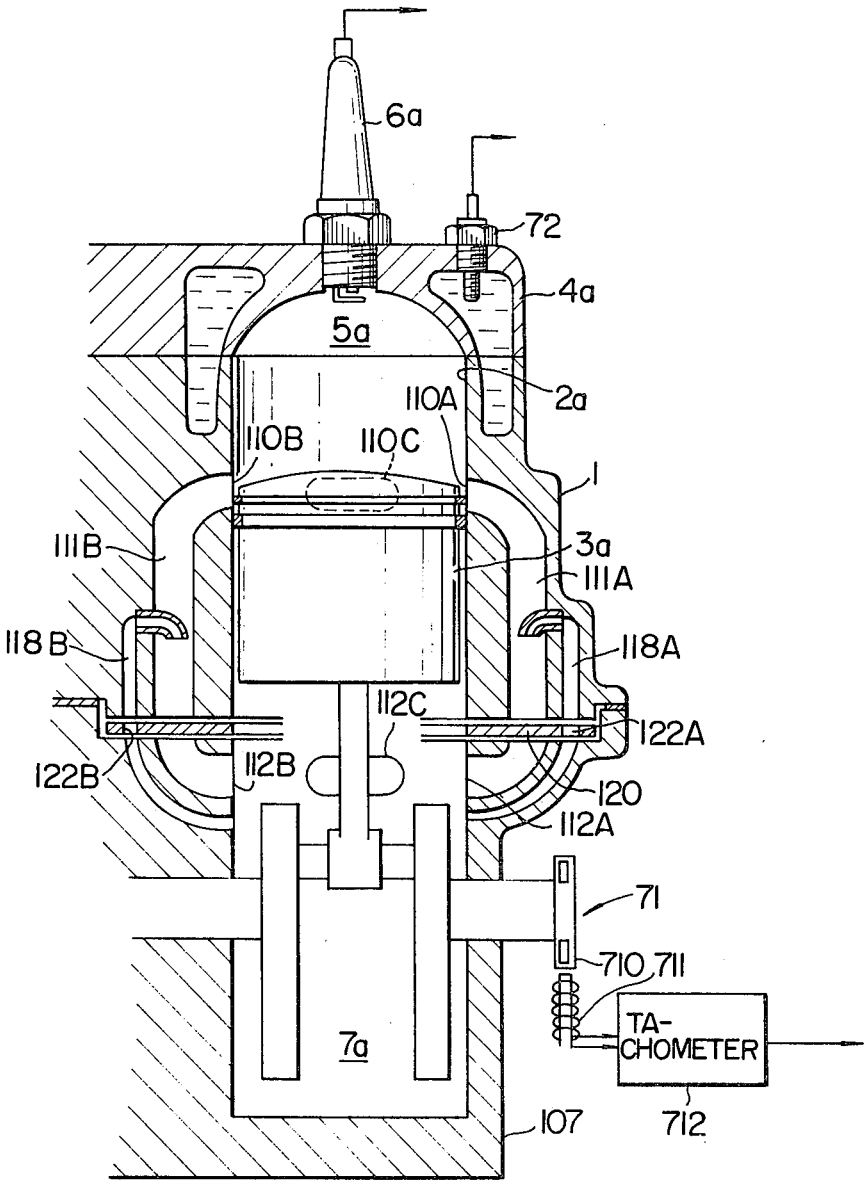
FIG. 14 is an enlarged sectional view taken along a line XIV—XIV in FIG. 13.

The fourth embodiment of the present invention is now explained with reference to the drawings, particularly on the difference from the first embodiment. In FIGS. 13 and 14, like numerals show like or corresponding parts to those shown in the first embodiment.

Referring to FIGS. 13 and 14, each of the cylinder bores **2*a* and 2*b* is provided with three scavenging bores 110A, 110B and 110C, and 210A, 210B and 210C, respectively, (the bores 210A to 210C being not shown), which communicate with scavenging ports 112A, 112B and 112C, and 212A, 212B and 212C, respectively, (the ports 212A to 212C being not shown) through scavenging passages 111A, 111B and 111C, and 211A, 211B and 211C, respectively, which extend from the cylinder block 1 to the crank case 107. The scavenging ports 112A, 112B and 112C, and 212A, 212B and 212C open to the crank chambers 7*a* and 7*b*, respectively. Of the three scavenging bores which open to each of the cylinder bores 2*a* and 2*b*, first and second scavenging bores 110A and 110B, or 210A and 210B are arranged oppositely to each other, and third scavenging bore 110C or 210C is arranged at a position transverse to the line connecting the first and second bores. The cylinder bores 2*a* and 2*b* each is provided with an exhaust bore 113 or 213 which is arranged to face the third scavenging bore 110C or 210C. Those scavenging bores 110A to 110C and 210A to 210C and the exhaust bores 113 and 213 are opened and closed by the reciprocation of the pistons 3*a* and 3*b*. Arranged between the cylinder block 1 and the crank case 107 are rotary valve plates 120 and 220 for each of the cylinders Ca and Cb. The rotary valve plates 120 and 220 are of ring shape and rotatable in planes normal to the scavenging passages 111A to 111C and 211A and 211C of the respective cylinders. They are positioned in the scavenging passages intermediate the scavenging ports and the scavenging bores. The rotary valve plates 120 and 220 each has three first bores 121A, 121B and 121C, and 221A, 221B and 221C, which correspond to the three scavenging passages of the respective cylinders and have the same shape as (but may be larger than) the scavenging passages and which are arranged coaxially with the scavenging passages. The scavenging passages of the respective cylinders are opened and closed in accordance with the rotating position of the rotary valve plates 120 and 220, to control the scavenging flow. In the present embodiment, therefore, the rotary valve plates 120 and 220** function as the scavenging control valves.

In the respective cylinders Ca and Cb, in addition to the normal scavenging passages 111A to 111C and 211A to 211C, auxiliary scavenging passage 118A and 118B, and 218A and 218B are provided near the first and second scavenging passages 111A and 111B, and 211A and 211B. Those auxiliary scavenging passages open to the corresponding crank chambers *7a* and *7b* at the bottoms thereof, and open to the first and second scavenging passages 111A and 111B, and 211A and 211B of the corresponding cylinders, at the tops thereof.

In the illustrated embodiment, two auxiliary scavenging passages are provided while no auxiliary scavenging passage being provided for the third scavenging passages 111C and 211C. The auxiliary scavenging passages 118A and 118B, and 218A and 218B open to the corresponding scavenging passages 111A and 111B, and 211A and 211B at positions in the scavenging passages closer to the scavenging bores (cylinder bores) than to the rotary valve plates 120 and 220. In this manner, the upstream ends and the downstream ends of the rotary valve plates in the first and second scavenging passages of the respective cylinders are bypassed by the auxiliary scavenging passages. The auxiliary scavenging passages open to the corresponding scavenging passages in the direction which is substantially opposite to the scavenging flows in the scavenging passages from the scavenging ports (crank chambers) to the scavenging bores (cylinder block), that is, in the downward direction as viewed in FIG. 14.

The passage area of each of the auxiliary scavenging passages is smaller than that of the scavenging passage so that the scavenging flow passing therethrough is substantially throttled.

The other peripheries of the rotary valve plates 120 and 220 of the respective cylinders are positioned at the intermediates of the auxiliary scavenging passages 118A, 118B, 218A and 218B, and the rotary valve plates 120 and 220 each is provided with two second bores 122A and 122B or 222A and 222B which have the same shape as (but may be larger than) the auxiliary scavenging passages. The auxiliary scavenging passages of the respective cylinders are thus opened and closed in accordance with the rotating position of the rotary valve plates 120 and 220 to control the auxiliary scavenging flow passing therethrough. Accordingly, the rotary valve plates 120 and 220 also function as the auxiliary scavenging control valves.

Figure 15:
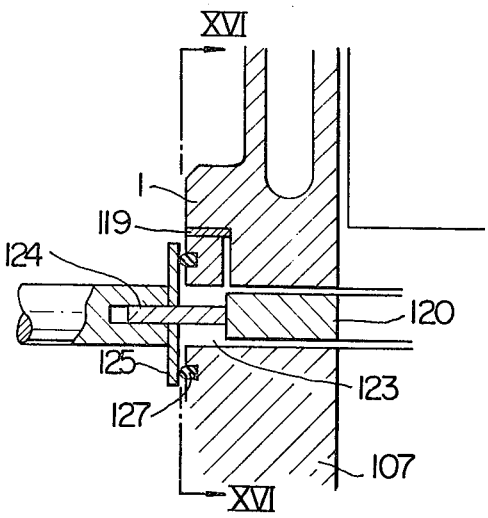
FIG. 15 is an enlarged sectional view taken along a line XV—XV in FIG. 13.
Figure 16:
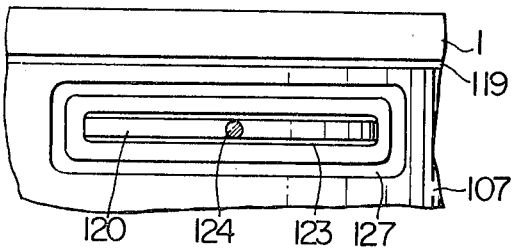
FIG. 16 is a sectional view taken along a line XVI—XVI in FIG. 15.

Rods 124 and 224 are fixed to the rotary valve plates 120 and 220 at positions facing to windows 123 and 223 formed in the crank case 107, and arcuate seal plates 125 and 225 are attached to the rods 124 and 224, as best shown in FIGS. 15 and 16. The seal plates 125 and 225 are adapted to be rotated with the corresponding rotary valve plates 120 and 220 along inner walls (facing the cylinder bores) of grooves 126 and 226 which extend along the sides of the windows 123 and 223. Appropriate means are provided to prevent the seal plates 125 and 225 from being disengaged from the grooves 126 and 226 over the entire rotation range of the rotary valve plates. The windows 123 and 223 of the respective cylinders are normally closed by the corresponding seal plates 125 and 225. O-rings 127 and 227 are mounted to the inner walls of the grooves 126 and 226 to surround the windows 123 and 223. The inner surfaces of the seal plates 125 and 225 are continuously brought into contact with the O-rings 127 and 227 to prevent gases from leaking from the windows 123 and 223. Appropriate clearances are maintained between the upper and lower surfaces of the rotary valve plates 120 and 220 and the cylinder block 1 and the crank case 107 to prevent the leakage of gases and the adhesion of the rotary valve plates. The clearances are adjusted by a gasket 119.

Links 130 and 230 are coupled to the rods 124 and 224, respectively, and first and second solenoids *22a* and *23a*, and *22b* and *23b*, as well as return springs *24a* and *24b* are coupled to the links 130 and 230, respectively. Those constitute rotating means for the corresponding rotary valve plates 120 and 220 and function to switch the corresponding rotary valve plates 120 and 220 to one of three rotating positions. That is, when the first and second solenoids *22a* and *23a*, or *22b* and *23b* are both not energized, the spring *24a* or *24b* rotates the corresponding rotary valve plate 120 or 220 clockwise as viewed in FIG. 13 for the first cylinder Ca or counterclockwise for the second cylinder Cb, to a first maximum rotation position. When only the first solenoid *22a* or *22b* is energized, the link 130 or 230 is pulled until it abuts against the second solenoid *23a* or *23b* to rotate the corresponding rotary valve plate 120 or 220 to a second intermediate rotation position. When the first and second solenoids *22a* and *23a*, or *22b* and *23b* are both energized, the corresponding rotary valve plate 120 or 220 is rotated to a third maximum rotation position counterclockwise as viewed in FIG. 13 for the first cylinder Ca and clockwise for the second cylinder Cb.

Figure 17A:
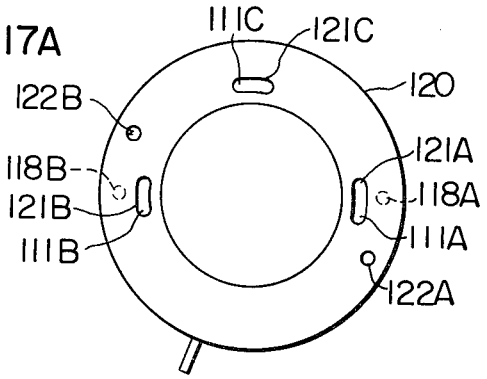
FIG. 17 A-C shows charts for illustrating actuated position of a rotary valves of the fourth embodiment.
Figure 17B:
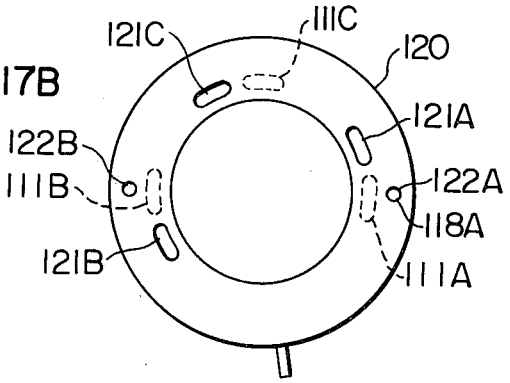
Figure 17C:
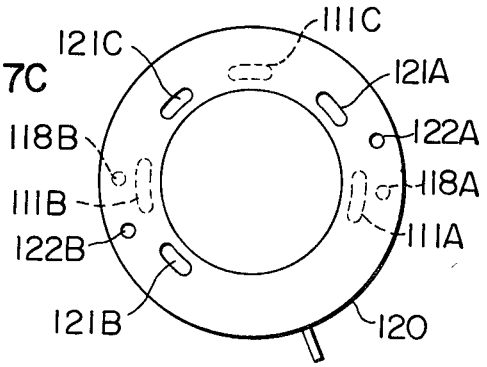
Figure 18A:
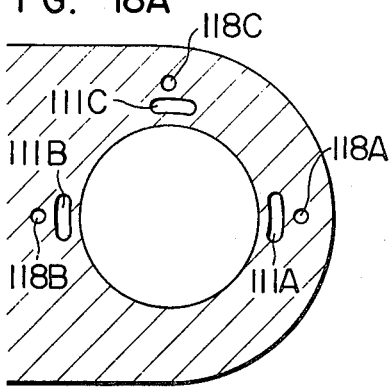
FIG. 18 A–D shows charts for illustrating major parts of a fifth embodiment of the present invention together with actuated position of a rotary valve.
Figure 18B:
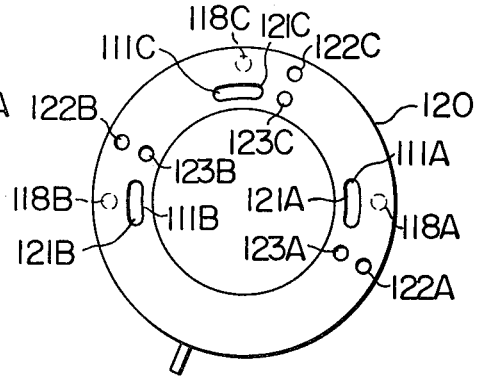
Figure 18C:
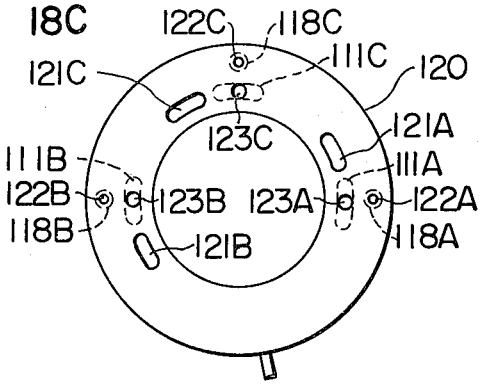
Figure 18D:
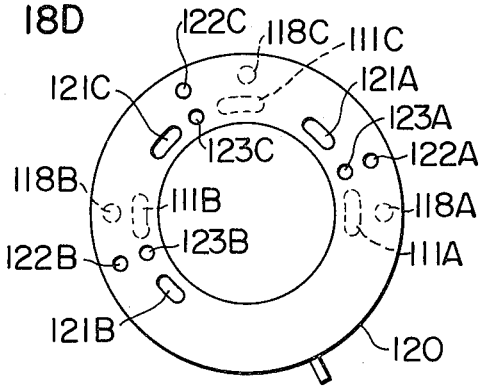

As shown in FIG. 17, at the first rotation position of the rotary valve plates 120 and 220, the three scavenging passages 111A to 111C and 211A to 211C of the respective cylinders meet the three first bores 121A to 121C and 221a to 221C, respectively, to fully open the scavenging passages, and close the auxiliary scavenging passages 118A and 118B, and 218A and 218B, as shown in FIG. 17A. At the second rotation position, the three scavenging passages of the respective cylinders are fully closed while the auxiliary scavenging passages 118A and 118B, and 218A and 218B meet the second bores 122A and 122B, and 222A and 222B, to open the auxiliary scavenging passages, as shown in FIG. 17B. At the third rotation position, all of the scavenging passages and all of the auxiliary scavenging passages of the respective cylinders are closed, as shown in FIG. 17C.

According to the present embodiment which uses the rotary plate valve described above, the normal jump-spark ignition combustion takes place in the corresponding cylinder at the first rotation position of the rotary valve plate 120 or 220 shown in FIG. 17A, that is, when the scavenging passages 111A to 111C or 211A to 211C are fully opened. At the second rotation position of the rotary valve plate 120 or 220 shown in FIG. 17B, that is, when the scavenging passages 111A to 111C or 211A to 211C are closed and instead the auxiliary scavenging passages 118A and 118B or 218A and 218B are opened, the compression ignition combustion takes place in the corresponding cylinder. At the third rotation position of the rotary valve plate 120 or 220 shown in FIG. 17C, that is, when all of the scavenging passages and all of the auxiliary scavenging passages are closed, the combustion operation is stopped, that is, fuel-cut takes place in the corresponding cylinder.

In the fourth embodiment described above, the control circuit 60 may be the same as that used in the first embodiment. Although the ignition device is not shown in the fourth embodiment, similar ignition device to that in the first embodiment may be used. In certain instances, the control mechanism of the ignition device may be omitted.

The operation of the fourth embodiment is, therefore, similar to the operation of the first embodiment described above, and hence the detailed description is not made here.

Fifth Embodiment

FIG. 18 shows a fifth embodiment of the present invention, and more particularly the scavenging passages of the first cylinder and the rotary valve plates for controlling the scavenging passages. As shown in FIG. 18A, three scavenging passages 111A to 111C are provided, each of which has an auxiliary scavenging passage 118A, 118B or 118C. In the fourth embodiment described above, all of the scavenging passages are closed while the auxiliary scavenging passages are opened by the rotary valve plate in the compression ignition operation. In the present embodiment, all of the scavenging passages and all of the auxiliary scavenging passages are throttled. To this end, the rotary valve plate 120 is provided with three first bores 121A, 121B and 121C which correspond to the scavenging passages 111A to 111C, respectively, three second bores 122A, 122B and 122C which correspond to the auxiliary scavenging passages 118A to 118C, respectively and have smaller passage areas than the auxiliary scavenging passages, and three third bores 123A, 123B and 123C which correspond to the scavenging passages 111A to 111C, respectively, and have smaller passage areas than the scavenging passages. In the normal jump-spark ignition operation, as shown in FIG. 18B, the auxiliary scavenging passages 118A to 118C are all closed by the rotary valve plate 120 while the scavenging passages 111A to 111C are all fully opened. In the compression ignition operation, as shown in FIG. 18C, the second bores 122A to 122C meet the auxiliary scavenging passages 118A to 118C, respectively, to throttle the auxiliary scavenging passages, and the third bores 123A to 123C meet the scavenging passages 111A to 111C, respectively, to throttle the scavenging passages. In this manner, the scavenging flow is throttled in both passages in the compression ignition operation. When the supply of air-fuel mixture is to be stopped, all of the scavenging passages 111A to 111C and all of the auxiliary scavenging passages 118A to 118C are fully closed.

Sixth Embodiment

In the embodiments described above, the electromagnetic solenoids are used as actuating means for the scavenging throttle valves (scavenging control valves). As will be shown in the six embodiment, diaphragm actuators may be used as the actuating means.

The sixth embodiment uses the rotary plate type valve. It will be explained mainly on the difference from the fourth embodiment described above. In the fourth embodiment (FIGS. 13 to 17), in addition to the scavenging passages 111A to 111C and 211A to 211C which communicate the crank chambers *7a* and *7b* to the combustion chambers Ca and Cb, the auxiliary scavenging passages 118A, 118B, 218A and 218B are provided. In the present or sixth embodiment shown in FIGS. 19 and 20, no such scavenging passage is provided but two opposing main scavenging passages **312*a* and 312*b* are provided. Like in the fourth embodiment, rotary valves 320*a* and 320*b* are rotatably mounted between the cylinder block and the crank case to control the scavenging passages 312*a* and 312*b***.

Actuators **325*a* and 325*b* are coupled to the rotary valves 320*a* and 320*b*, respectively, and they function as actuating means for rotating the rotary valves. They may be known diaphragm type actuators. Pressures applied to the actuators 325*a* and 325*b* are controlled by pressure controllers 330*a* and 330*b*, respectively, which supply one of three different pressures depending on the operating condition of the engine. In the present embodiment, the three different pressures includes atmospheric pressure, suction manifold vacuum and a vacuum of the suction manifold vacuum bleeding to the atmosphere. Accordingly, the actuators 325*a* and 325*b* rotate the corresponding valves 320*a* and 320*b* to one of three positions depending on the pressures supplied thereto. When the atmosphere is introduced, the rotor valve 320*a* or 320*b* is rotated to a position where the first bores 321*a* or 321*b* of the rotary valve 320*a* or 320*b* meet the scavenging passages 312*a* or 312*b*. When the bleeded vacuum is introduced, the rotary valve is rotated to a position where the second bores 322*a* or 322*b* meet the scavenging passages 312*a* or 312*b***, and when the suction manifold vacuum is introduced, the rotary valve is rotated to a position where the scavenging passages are closed.

In the sixth embodiment thus constructed, like in the fourth embodiment described above, the normal jump-spark ignition operation takes place in both cylinders in the normal load operation, to assure necessary output power. In the non-load operation which usually raise a problem in improving the purification of exhaust gas and the combustion efficiency and in which gas feed ratio is low, the compression ignition operation takes place in the first cylinder Ca while the supply of air-fuel mixture to the second cylinder Cb is stopped to prevent the disordered combustion and the blow-out of the newly supplied gas. Where necessary, the supply of air-fuel mixture to both cylinders is stopped in the deceleration operation, and the compression ignition operation is carried out in both cylinders in the low load operation to further improve the purification of exhaust gas and the combustion efficiency. Further, in the warm-up operation, the normal jump-spark ignition operation is carried out in both cylinders.

In the normal jump-spark ignition operation, atmosphere is introduced to the actuators **325*a* and 325*b* for the rotary valves of both cylinders. The rotary valve plate 320*a* of the first cylinder Ca is rotated to the position shown in FIG. 20A where the first bores 321*a* meet the scavenging passages 312*a* to fully open the scavenging passages 312*a*. The rotary valve plate 320*b* of the second cylinder Cb is also rotated to a similar position to fully open the scavenging passages 312*b*. Atmosphere is also introduced to the vacuum actuator 31 for the exhaust throttle valve 30 to fully open the exhaust throttle valve 30 and fully close the bypass passage switching valve 41**. In this manner, the same suction and exhaust conditions as the conventional engine are attained, and the normal jump-spark ignition operation takes place.

Figure 19:
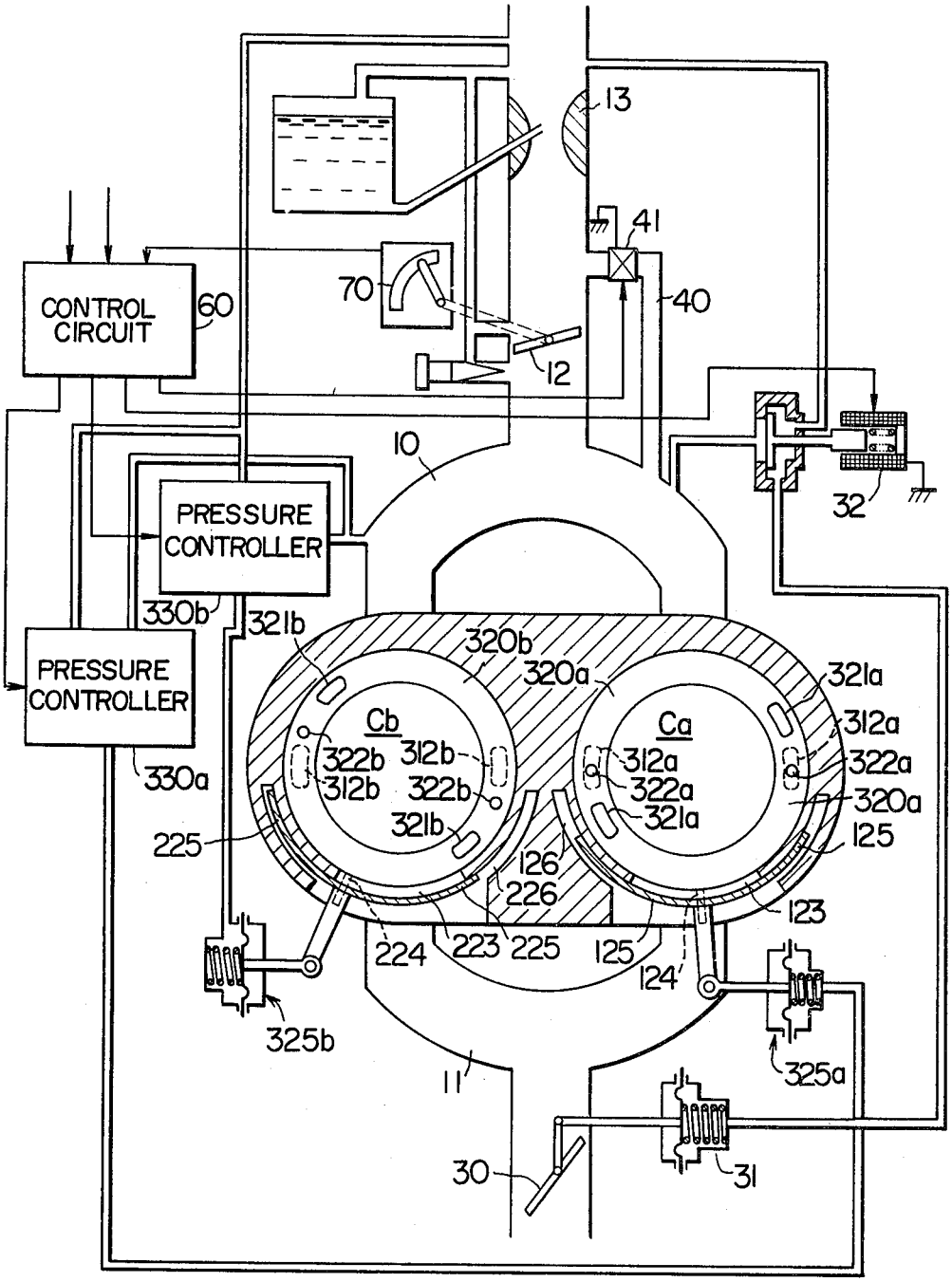
FIG. 19 shows a configuration illustrating a sixth embodiment of the present invention.
Figure 20A:
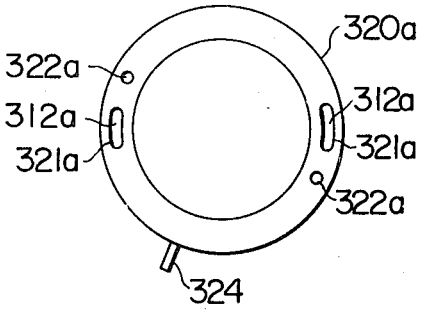
FIG. 20 A–C shows charts for illustrating actuated position of a rotary valve in the sixth embodiment.
Figure 20B:
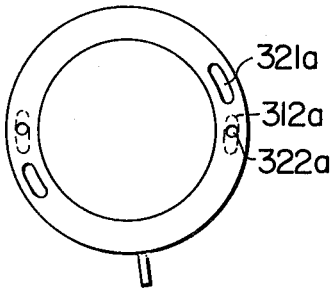

In the non-load operation where the compression ignition operation takes place in the first cylinder, bleeded vacuum is introduced to the rotary valve actuator **325*a* of the first cylinder Ca to rotate the rotary valve plate 320*a* such that the second bores 322*a* which are formed in the rotary valve plate 320*a* and have smaller area than the scavenging passages 312*a* meet the scavenging passages 312*a* as shown in FIG. 20B, to throttle the scavenging passages 312***a*. On the other hand, in the second cylinder Cb, the suction manifold vacuum is introduced to the actuator 325*b* to rotate the rotary valve plate 320*b* to its extreme position to fully close the scavenging passages 312*b* as shown in FIG. 19. Further, the vacuum is introduced to the vacuum actuator 31 for the exhaust throttle valve 30 to partially open the exhaust throttle valve 30 to throttle the exhaust passage (exhaust manifold 11). Further, the switching valve 41 for the bypass passage 40 is opened.

In this manner, the gas feed ratio in the first cylinder Ca is increased, and the scavenging flow and the exhaust flow in the first cylinder Ca are throttled to cause the scavenging flow to gently flow into the combustion chamber so that the gas flow in the combustion chamber is suppressed to promote the mixing of the newly supplied gas and the residual gas. The blow-out of the newly supplied gas is also prevented. The newly supplied gas is heated by the heat of the residual gas and it is further heated during the compression to a point sufficient for spontaneous ignition so that the compression ignition operation takes place. Since this compression ignition operation is similar to the run-on phenomenon, it prevents the disordered combustion and the blow-out of the newly supplied gas to improve the purification of the exhaust gas and the combustion efficiency.

Figure 20C:
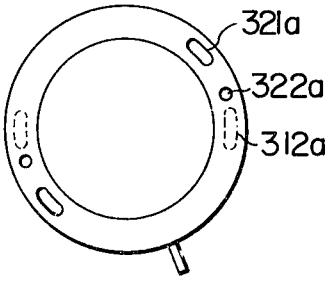

When the supply of air-fuel mixture is to be stopped by the rotary valve, the suction manifold vacuum is introduced to the actuators 325*a* and 325*b* for the rotary valves of both cylinders Ca and Cb, so that the rotary valve plates 320*a* and 320*b* of both cylinders Ca and Cb are rotated to the maximum rotation position to fully close the scavenging passages 312*a* and 312*b* by the rotary valve plates 320*a* and 320*b* as shown in FIG. 20C for the first cylinder Ca and in FIG. 19 for the second cylinder Cb. In this manner, the supply of air-fuel mixture to both cylinders is stopped.

In the compression ignition operation in both cylinders Ca and Cb, the second bores 322*a* and 322*b* of the rotary valve plates 320*a* and 320*b* of the cylinders Ca and Cb meet the scavenging passages 312*a* and 312*b*, respectively, to throttle both scavenging passages 312*a* and 312*b*, while the exhaust throttle valve 30 is partially opened to throttle the exhaust passage. In this manner, a similar condition to that of the non-load operation by the first cylinder Ca is established in the cylinders Ca and Cb so that the compression ignition operation is carried out.

By the valve device described above, it is easy to carry out the normal jump-spark operation in the first cylinder while the supply of air-fuel mixture to the second cylinder is stopped, or vice versa. In shifting the operation mode of either cylinder from the stop of supply of the air-fuel mixture to the compression ignition operation, the shift can be smoothly carried out by temporarily carrying out the jump-spark ignition operation in that cylinder.

According to the arrangement described above, the disordered combustion and the blow-out of the newly supplied gas can be prevented without substantial decrease of output power, and the amount of exhaust of unburnt gases (CO, HC) can be considerably reduced and the combustion efficiency can be improved. Further, although each cylinder has two scavenging passages, the passage areas thereof can be controlled by rotating single rotary valve for each cylinder. Accordingly, the construction is simplified and the control of the passage area is precise. The sealing required to stop the supply of air-fuel mixture is also satisfactory.

What is claimed is:

1. Method for operating a multi-cylinder internal combustion engine comprising the steps of:

throttling both a suction flow of air-fuel mixture newly supplied to a first combustion chamber and an exhaust flow of combustion gas flowing out of said first combustion chamber, or throttling only said exhaust flow during a non-load operation of the engine to cause compression ignition combustion to occur in said first combustion chamber; and stopping a suction flow of air-fuel mixture newly supplied to a second combustion chamber during said non-load operation to stop combustion operation in said second combustion chamber.

2. Method for operating a multi-cylinder internal combustion engine according to claim 1, further comprising the step of:

supplying additional new air-fuel mixture to said first combustion chamber during said non-load operation of said engine.

3. Method for operating a multi-cylinder internal combustion engine according to claim 2, further comprising the steps of:

throttling at least said exhaust flow from said first combustion chamber during low-speed, low-load operation of said engine; and throttling both a suction flow of air-fuel mixture newly supplied to said second combustion chamber and said exhaust flow of combustion gas flowing out of said second combustion chamber or throttling only said exhaust flow during said low-speed, low-load operation of said engine to cause compression ignition combustion to occur in said second combustion chamber.

4. Method for operating a multi-cylinder internal combustion engine according to claim 3, further comprising the steps of:

in shifting operation mode of said engine from said non-load operation to said low-speed, low-load operation, throttling either one of said suction flow to said first combustion chamber and said exhaust flow from said first combustion chamber to maintain said compression ignition combustion in said first combustion chamber; and causing normal jump-spark ignition combustion to occur in said second combustion chamber at an advanced ignition timing.

5. Method for operating a multi-cylinder internal combustion engine according to claim 1, further comprising the step of:

stopping the suction flows of newly supplied air-fuel mixture to said first and second combustion chambers during rapid deceleration operation of said engine to stop the combustion operations in said first and second combustion chambers.

6. Method for operating a multi-cylinder internal combustion engine according to claim 5, further comprising the step of:

causing jump-spark ignition operation to occur in said first combustion chamber when an engine r.p.m. falls below a predetermined r.p.m. during said deceleration operation of said engine.

7. Method for operating a multi-cylinder internal combustion engine according to claim 6, further comprising the step of:

advancing ignition timing in said first combustion chamber carrying out the jump-spark ignition operation when the engine r.p.m. falls below said predetermined r.p.m. during said deceleration operation of said engine.

8. Method for operating a multi-cylinder internal combustion engine according to claim 6, further comprising the step of:

supplying additional new air-fuel mixture to said first combustion chamber carrying out the jump-spark ignition operation when said engine r.p.m. falls below said predetermined r.p.m. during said deceleration operation of said engine.

9. Method for operating a multi-cylinder internal combustion engine according to claim 1, further comprising the step of:

causing normal jump-spark ignition combustion to occur in said first and second combustion chambers during warm-up operation of said engine where engine temperature is below a predetermined temperature.

10. Method for operating a multi-cylinder internal combustion engine according to claim 1, further comprising the step of:

maintaining the jump-spark combustion in said first combustion chamber while stopping the suction flow of newly supplied air-fuel mixture to said second combustion chamber to stop the combustion operation in said second combustion chamber when an engine r.p.m. falls below a predetermined r.p.m. during deceleration operation of said engine.

11. Method for operating a multi-cylinder internal combustion engine according to claim 10, further comprising the step of:

supplying additional new air-fuel mixture to said first combustion chamber carrying out the jump-spark ignition combustion when said engine r.p.m. falls below said predetermined r.p.m. during said deceleration operation of said engine.

12. A 2-cycle internal combustion engine comprising:

a cylinder having first and second cylinder bores;

first and second pistons reciprocally disposed in the respective cylinder bores;

a cylinder head cooperating with said cylinder and said pistons to define first and second combustion chambers, respectively;

first and second spark plugs exposed to said first and second combustion chambers, respectively, for igniting air-fuel mixture introduced therein by spark discharges;

an ignition control device for supplying ignition energy to said first and second spark plugs at respective ignition timings;

means disposed in a suction passage for producing said air-fuel mixture;

a throttle valve pivotally disposed in said suction passage downstream of said air-fuel mixture producing means for controlling the amount of said air-fuel mixture;

first and second suction manifold branches connected to said suction passage downstream of said throttle valve;

first and second suction ports operatively communicated with said first and second suction manifold branches, said first and second suction ports opening to said first and second combustion chambers, respectively, for introducing said air-fuel mixture thereto;

first and second exhaust ports opening to said first and second combustion chambers, respectively, for exhausting combustion gases produced therein;

an exhaust manifold connected to said exhaust ports for conveying the combustion gases to an atmosphere;

first throttle means arranged in at least one of said first suction port, said first exhaust port and said first exhaust manifold, for throttling at least one of a suction flow of the air-fuel mixture supplied to said first combustion chamber through said first suction port and an exhaust flow of the combustion gas flowing out of said first combustion chamber through said first exhaust port and said first exhaust manifold, during non-load operation of said engine, to cause compression ignition operation to occur in said first combustion chamber; and second throttle means arranged in at least one of said second suction port and said second suction manifold for stopping the supply of suction flow of the air-fuel mixture supplied to said second combustion chamber through said second suction port, during said non-load operation of said engine, to stop combustion operation in said second combustion chamber.

13. A 2-cycle internal combustion engine according to claim 12, wherein;

said first and second throttle means do not throttle the suction flows to said first and second combustion chambers and the exhaust flows from said first and second combustion chambers when an engine temperature is lower than a predetermined temperature, to cause normal jump-spark ignition combustion to occur in said first and second combustion chambers.

14. A 2-cycle internal combustion engine according to claim 12, further comprising:

means for supplying additional air-fuel mixture to said first combustion chamber during the non-load operation of said engine.

15. A 2-cycle internal combustion engine according to claim 12, wherein;

said first throttle means comprises a scavenging valve arranged in said first suction port to throttle the suction flow of the air-fuel mixture supplied to said first combustion chamber.

16. A 2-cycle internal combustion engine according to claim 12, wherein;

said first throttle means comprises an throttle valve arranged in said exhaust manifold to throttle the exhaust flow of the combustion gas flowing out of said first combustion chamber.

17. A 2-cycle internal combustion engine according to claim 12, wherein;

said first throttle means comprises a scavenging valve arranged in said first suction port to throttle the suction flow of the air-fuel mixture supplied to said first combustion chamber, and an exhaust throttle valve arranged in said exhaust manifold to throttle the exhaust flow of the combustion gas flowing from said first combustion chamber.

18. A 2-cycle internal combustion engine according to claim 12, wherein;

said second throttle means comprises a scavenging valve arranged in said second suction port to stop the suction flow of the air-fuel mixture supplied to said second combustion chamber.

19. A 2-cycle internal combustion engine according to claim 12, wherein;

said second throttle means comprises a scavenging valve arranged in said second suction manifold branch to stop the suction flow of the air-fuel mixture supplied to said second combustion chamber.

20. A 2-cycle internal combustion engine according to claim 12, wherein;

during low-speed, low-load operation of said engine, said first throttle means throttles either one of the suction flow to said first combustion chamber and the exhaust flow from said first combustion chamber to maintain the compression ignition combustion in said first combustion chamber, and said second throttle means throttles the suction flow to said second combustion chamber to cause the compression ignition combustion to occur in said second combustion chamber.

21. A 2-cycle internal combustion engine according to claim 20, wherein;

during transitional operation of said engine from said non-load operation to said low-speed, low-load operation, said first throttle means throttles either one of the suction flow to said first combustion chamber and the exhaust flow from said first combustion chamber to maintain the compression ignition combustion in said first combustion chamber, and said second throttle means causes the passage in which it is arranged to be fully opened to cause the normal jump-spark ignition combustion to occur in said second combustion chamber.

22. A 2-cycle internal combustion engine according to claim 21, wherein;

said ingition control device includes means for advancing ignition timing for said second spark plug during said transitional operation of said engine from said non-load operation to said low-speed, low-load operation.

23. A 2-cycle internal combustion engine according to claim 12, wherein;

said first and second throttle means stop the supply of the air-fuel mixture to said first and second combustion chambers, respectively, during rapid deceleration operation of said engine, to stop the combustion operations in said first and second combustion chambers.

24. A 2-cycle internal combustion engine according to claim 23, wherein;

said first throttle means causes the passage in which it is arranged to be fully opened and when an engine r.p.m. falls below a predetermined r.p.m. during the rapid deceleration operation of said engine, to cause the normal jump-spark ignition combustion to occur in said first combustion chamber.

25. A 2-cycle internal combustion engine according to claim 24, wherein;

said ignition control device includes means for advancing ignition timing for said first spark plug when the engine r.p.m. falls below said predetermined r.p.m. during the rapid deceleration operation of said engine.

26. A 2-cycle internal combustion engine according to claim 24, further comprising:

means for supplying additional air-fuel mixture to said first combustion chamber when said engine r.p.m. falls below said predetermined r.p.m. during the rapid deceleration operation of said engine.

27. A 2-cycle internal combustion engine according to claim 12, wherein;

when an engine r.p.m. falls below a predetermined r.p.m. during deceleration operation of said engine, said first throttle means maintain the passage in which it is arranged fully opened to maintain the normal jump-spark ignition combustion in said first combustion chamber, and said second throttle means stops the supply of the suction flow of the air-fuel mixture to said second combustion chamber to stop the combustion operation in said second combustion chamber.

28. A 2-cycle internal combustion engine according to claim 27, further comprising:

means for supplying additional air-fuel mixture to said first combustion chamber carrying out the jump-spark ignition combustion when the engine r.p.m. falls below said predetermined r.p.m. during the deceleration operation of said engine.

29. A 2-cycle internal combustion engine according to claim 14, wherein;

said means for supplying additional air-fuel mixture comprises a bypass passage for connecting said suction passage extending between said air-fuel mixture producing means and said throttle valve with said first suction manifold branch to bypass said throttle valve, and a solenoid valve arranged in said bypass passage to open said bypass passage during the non-load operation of said engine.

30. A 2-cycle internal combustion engine according to claim 26 wherein;

said means for supplying additional air-fuel mixture comprises a bypass passage for connecting said suction passage extending between said air-fuel mixture producing means and said throttle valve with said first suction manifold branch to bypass said throttle valve, and a solenoid valve arranged in said bypass passage to open said bypass passage when the engine r.p.m. falls below said predetermined r.p.m. during the deceleration operation of said engine.

31. A 2-cycle internal combustion engine according to claim 27, wherein:

said means for supplying additional air-fuel mixture comprises a bypass passage connecting said suction passage extending between said air-fuel mixture producing means and said throttle valve with said first suction manifold branch to bypass said throttle valve, and a solenoid valve arranged in said bypass passage to open said bypass passage when the engine r.p.m. falls below said predetermined r.p.m. during the deceleration operation of said engine.

32. A 2-cycle internal combustion engine according to claim 22, wherein;

said means for advancing the ignition timing comprises a passage for connecting a vacuum chamber controlling the ignition timing of said ignition control device with one of said suction manifold branches, and a solenoid valve arranged in said passage to open said passage during said transitional operation to introduce the suction vacuum to said vacuum chamber.

33. A 2-cycle internal combustion engine according to claim 25, wherein;

said means for advancing the ignition timing comprises a passage for connecting a vacuum chamber controlling the ignition timing of said ignition control device with one of said suction manifold branches, and a solenoid valve arranged in said passage to open said passage when the engine r.p.m. falls below said predetermined r.p.m. during the deceleration operation of said engine, to introduce the suction vacuum to said vacuum chamber.

* * * * *